US005285588A

United States Patent [19]

Niemela et al.

[11] Patent Number: 5,285,588

[45] Date of Patent: Feb. 15, 1994

[54] WINGED PLOW

[75] Inventors: W. Wally Niemela, Rte. 1, Box 289, Chassell, Mich. 49916; Philip J. Quenzi, Atlantic Mine, Mich.

[73] Assignee: W. Wally Niemela, Bonita Springs, Fla.

[21] Appl. No.: 912,896

[22] Filed: Jul. 13, 1992

[51] Int. Cl.[5] ..... E01H 5/04

[52] U.S. Cl. ..... 37/234; 37/232; 37/274; 37/283

[58] Field of Search ..... 37/232, 266, 267, 274, 37/279, 281, 283, 234

[56] References Cited

U.S. PATENT DOCUMENTS

| | | | |
|---|---|---|---|
| 1,927,078 | 9/1933 | Weeks . | |
| 2,410,543 | 11/1946 | Kesler | 37/274 X |
| 2,667,708 | 2/1954 | Gjesdahl . | |
| 3,250,026 | 5/1966 | Jocher et al. . | |
| 3,410,008 | 11/1968 | Standfuss . | |
| 3,477,151 | 11/1969 | Zanella | 37/281 |
| 3,775,877 | 12/1973 | Gove, Sr. . | |
| 3,807,064 | 4/1974 | Schmidt, Jr. . | |
| 3,845,577 | 11/1974 | Naymik . | |
| 4,074,448 | 2/1978 | Niemela | 37/195 X |
| 4,145,825 | 3/1979 | Bertolino | 37/281 X |
| 4,249,323 | 2/1981 | Mathis et al. | 37/232 |
| 4,479,312 | 10/1984 | Turgeon | 37/281 X |
| 4,658,519 | 4/1987 | Quenzi | 37/273 X |
| 4,991,323 | 2/1991 | Benkler | 37/232 X |

FOREIGN PATENT DOCUMENTS

| | | | |
|---|---|---|---|
| 140139 | 5/1985 | European Pat. Off. | 37/281 |

OTHER PUBLICATIONS

Farm Industry News, vol. 23 No. 7, p. 25 Jul./Aug. 1990.

Excel brochure entitled "Climb into the Snow Track 440 and Start Building Cross-Country Skiing Excitement", Copyright 1989.

Excel Hustler brand brochure outside cover and inside page entitled "Still Out Front in Productivity", Copyright 1988.

Snow Craft Industries, Inc. brochure believed publsihed at least one year prior to filing this application.

*Primary Examiner*—Dennis L. Taylor
*Assistant Examiner*—Arlen L. Olsen
*Attorney, Agent, or Firm*—Price, Heneveld, Cooper, DeWitt & Litton

[57] ABSTRACT

A winged plow for moving snow or other materials with a vehicle has a support frame pivotally connected with one end of a plow vehicle. An elongated plow blade having two opposing ends is pivotally connected with the terminal end of the support frame for generally horizontal rotation between a centered position with the plow blade oriented generally perpendicular to the support frame and an angled position with the plow blade rotated substantially away from the centered position. One of a pair of plow blade wings is pivotally connected at each of the opposing ends of the plow blade for rotation between a closed position in which the wings project generally forward, the wings and plow blade defining a generally U-shaped assembly, and an open position in which the wings project in generally opposite directions, away from each other, effectively extending the length of the plow blade. An actuator, which may be cable, hydraulically or mechanically operated, is responsive to the position of the plow blade relative to the support frame manipulates the wings between the closed position when the plow blade is substantially in the centered position and the open position when the plow blade is rotated substantially away from the centered position, either left or right.

58 Claims, 14 Drawing Sheets

WINGED PLOW

BACKGROUND OF THE INVENTION

The present invention relates to winged plow assemblies for use with a vehicle.

Straight blade plows cantilevered from an end of a plow vehicle are commonly found in those geographic regions where winter snow accumulation must be cleared from a surface, such as streets, parking lots, and walkways for example, so that people may travel about their daily business without undue hazard from deep snow. During the plowing operation, a plow may be operated either in a centered position, being generally square with the vehicle and generally perpendicular to the vehicle motion, or in an angled position in which the plow is directed toward one side or the other at an angle to the vehicle motion. When plowing with the plow centered, snow will accumulate in front of the plow and typically spill over the ends of the plow. Thus, in the interest of increased plowing efficiency, plow operators are known to fix plates at the ends of the plow blade to minimize such spill over and retain the snow in front of the blade to effectively increase the plow capacity. However, while these additional plates enhance straight line plowing, they are equally detrimental to angled plowing because the plates then effectively clog the blade surface with accumulated snow, thwarting the objective of casting snow to the side during angled plowing.

Accordingly, a need has been recognized for plows to enable either angled or straight/centered plowing, and to increase the efficiency of the plow in the centered position by preventing spill over from the plow ends while allowing proper material flow along the plow blade during angled plowing.

SUMMARY OF THE INVENTION

The present invention addresses the above-described need with a winged plow assembly which enhances both centered and angled plowing. The winged plow assembly includes a support frame pivotally connected with the plow vehicle. An elongated plow blade is pivotally connected with the support frame for generally horizontal rotation of the plow blade between centered and angled positions. A pair of plow blade wings are pivotally connected with the plow blade, one wing being located at each of two opposing ends of the plow blade. The wings rotate between a closed position wherein the wings project generally forward from the plow blade, the wings and blade defining a generally U-shaped assembly in the closed position so that the wings facilitate pushing material with the plow, and an open position in which the wings project in generally opposite directions away from each other and effectively extend the length of the plow blade so that the wings facilitate moving material to the side of the plow. An actuator automatically rotates the wings between the closed position when the plow blade is in a centered position, generally perpendicular to a longitudinal centerline of the plow vehicle, and the open position when the plow blade is rotated substantially away from the centered position to an angled position.

In one aspect of the invention, the actuator interconnects the wings with the support frame. The wings may also be biased to the closed position and the actuator may further include cabling connected with each wing and the support frame for pulling the wings into the open position when the plow blade is rotated substantially away from the centered position.

The actuator may also include a latch for latching the wings in the closed position. The latch may be adapted to release the wings from the closed position for rotation to the open position when the plow blade is rotated substantially away from the centered position.

In an alternative aspect of the invention, the actuator may include a mechanical power source interconnected between at least one wing and the plow blade. The actuator may also include a control for the mechanical power source which is adapted for sensing the position of the plow blade relative to the support frame for sending an open signal to the mechanical power source when the plow blade is rotated substantially away from the centered position. Further, the mechanical power source may be a hydraulic cylinder.

Alternatively, a mechanical linkage may be connected between the support frame and plow to open and close the plow wings as the plow is pivoted horizontally between centered and angled positions.

In another aspect of the invention, the plow blade may also be pivotally connected with the support frame not only for horizontal rotation, but also for rotation about a generally horizontal axis between a normally generally vertical position and a generally horizontal, trip position when a bottom edge of the plow blade engages a protrusion from a surface to be cleared. The blade ma be biased to the normally vertical position. Further, the cabling of the actuator may extend along the plow blade from each wing to the support frame and be positioned adjacent the horizontal axis of rotation of the plow blade.

In yet another aspect of the invention, horizontal rotation of the plow blade may be provided by a power rotation device. The power rotation device may include a pair of hydraulic cylinders positioned so that one cylinder extends between the plow blade and each one of two opposing sides of the support frame.

Accordingly, the present invention provides a plow with a pivotable wing at each of two opposing ends of a plow blade and an actuator for rotating the wings between a closed position when the plow blade is in a centered position and an open position when the plow blade is rotated substantially away from the centered position to an angled position. Thus, straight-ahead plowing with the plow blade in a generally centered position is enhanced by closed wings on the ends of the plow blade to resist spill over of material around the ends of the plow blade, capturing more material in front of the plow blade to thereby increase the straight-ahead plowing efficiency. Further, angled plowing is accommodated and made more efficient since the wings rotate to an open position when the plow blade is rotated substantially away from the centered position. The plowed material is thereby cast off to the side of the plow path at the trailing end of the plow blade, rather than being captured by a closed trailing wing and clogging the plow blade with the captured material. Angled plowing efficiency is also enhanced since the open wings effectively extend the length of the plow blade and the plowed width is not diminished by rotating the plow blade substantially away from the centered position.

These and other objects, advantages, purposes and features of the invention will become more apparent from a study of the following description taken in conjunction with the drawings.

DESCRIPTION OF THE PREFERRED EMBODIMENTS

Figure 1:
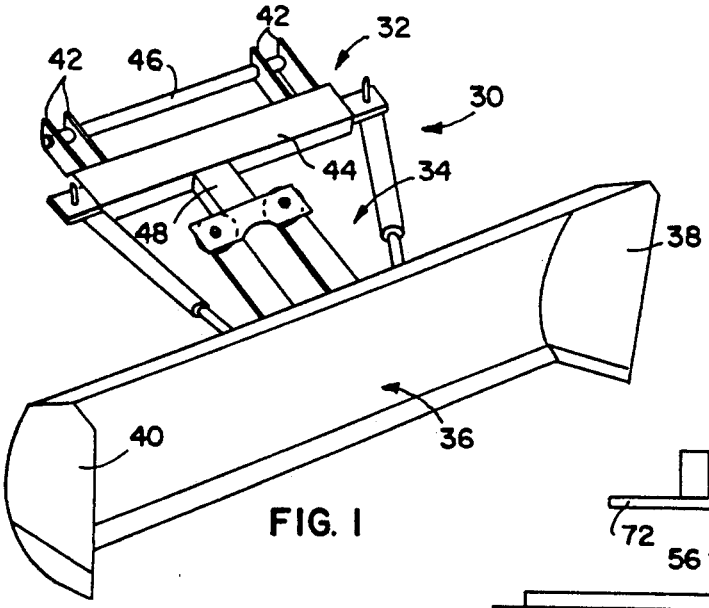
FIG. 1 is a perspective view of a first embodiment of a winged plow assembly according to the present invention.

Referring to the drawings in greater detail, FIG. 1 shows a winged plow assembly 30 according to the present invention including a support frame 32, a plow carrier 34, a plow blade 36, a pair of blade wings 38 and 40, and an actuator which will be described in greater detail below.

Figure 2:
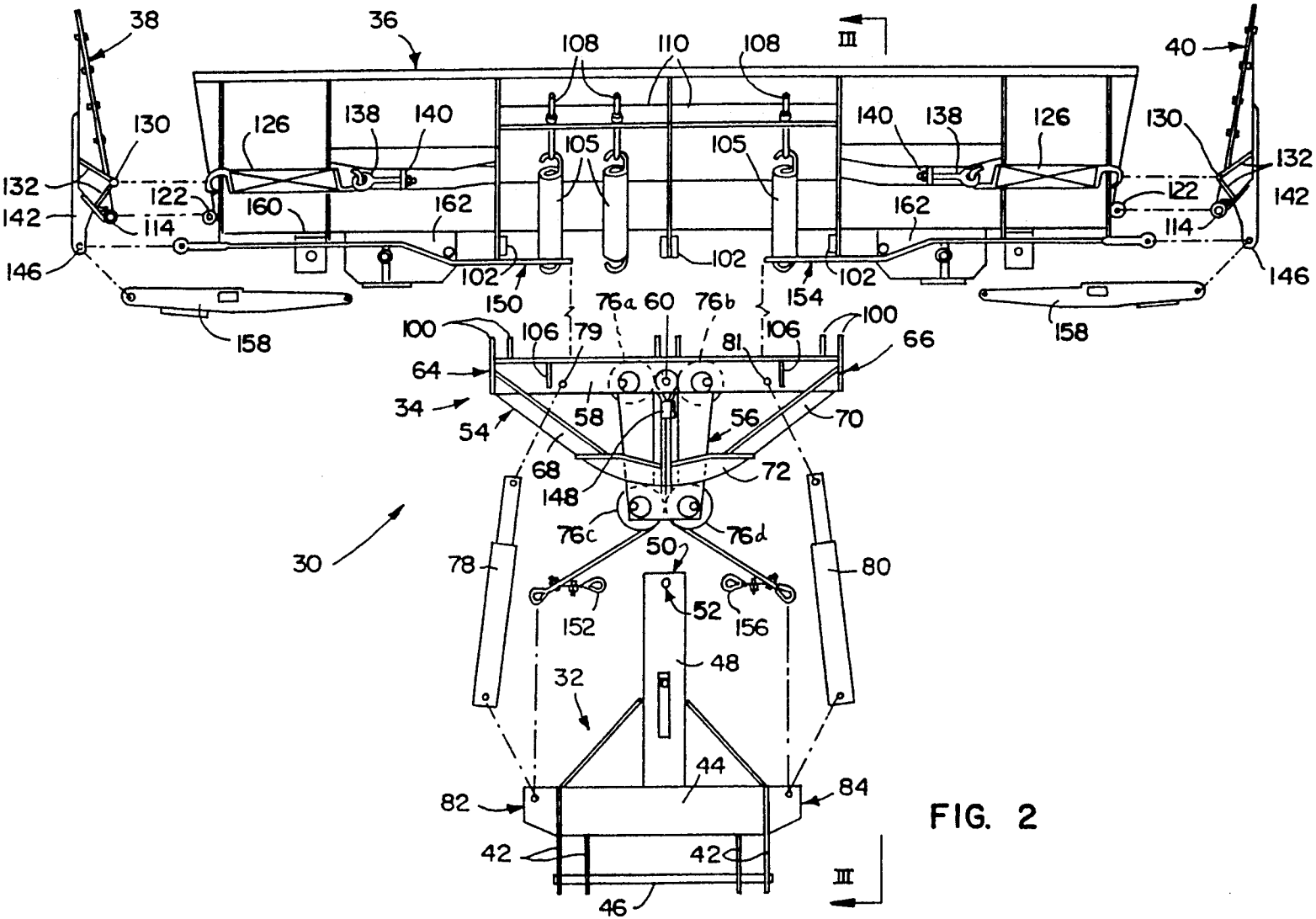
FIG. 2 is an exploded top plan view of the plow assembly of FIG. 1.
Figures 8, 9, 10:
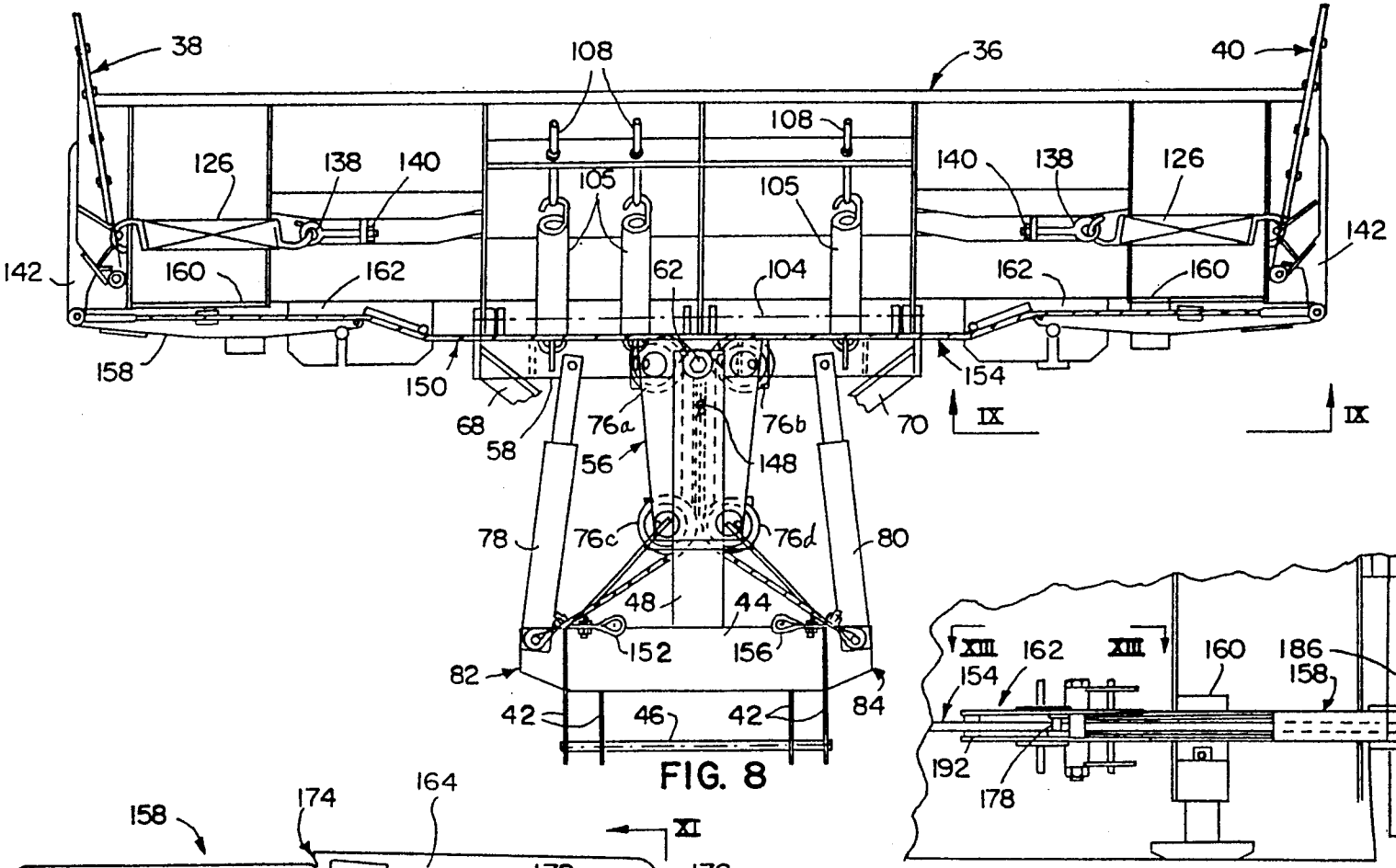
FIG. 8 is a partial fragmentary top plan view of the plow assembly of FIG. 1 in a centered position, with the wings closed.
FIG. 9 is a fragmentary rear elevational view of the right end of the plow blade of FIG. 1 taken along line IX—IX of FIG. 8.
FIG. 10 is a top plan view of a latch arm of the plow assembly of FIG. 1.

Support frame 32 may be any of the commonly known vehicle mounted plow support frames, commonly referred to as a T- or A-frame, and pivotally connected with the plow vehicle for movement about a generally horizontal axis to raise and lower the entire plow assembly. One of the various commonly known pivot connections between the vehicle and support frame 32 includes a number of pivot plates 42 projecting rearwardly from a cross member 44 (FIGS. 1, 2, and 8). Pivot plates 42 are adapted to receive a pivot pin 46 and to couple with cooperating pivot members (not shown) on the plow vehicle. Pivot plates 42 couple with the pivot members and pivot pin 46 interconnects the pivot plates with the pivot members in a hinge-like manner. As is best seen in FIG. 2, longitudinal frame member 48 extends forward from cross member 44 to a terminal end 50 and has a generally vertically oriented pivot pin aperture 52 extending through longitudinal frame member 48 near terminal end 50.

Figure 5:
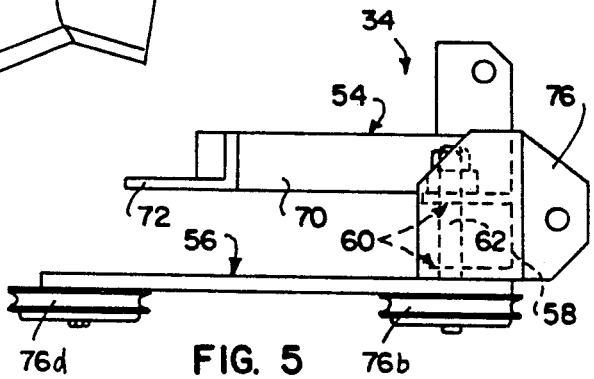
FIG. 5 is a right side elevational view of the plow carrier of FIG. 1.
Figure 4:
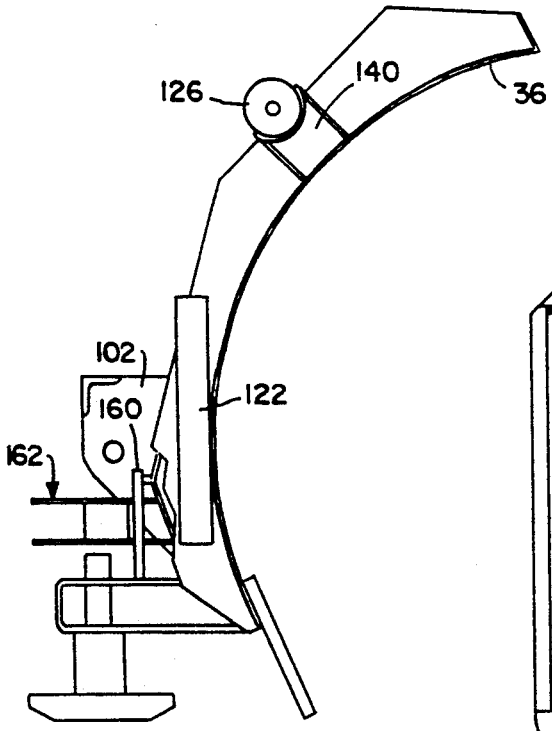
FIG. 4 is a right end elevational view of the plow blade of FIG. 1 with the wing removed.

Plow carrier 34 has a generally triangular upper frame 54 and a generally trapezoidal lower frame 56 (FIGS. 2 and 5). Each of the upper and lower frames 54, 56 extend rearwardly from opposing top and bottom sides, respectively, of a transverse carrier member 58 (FIGS. 2 and 5). Transverse carrier member 58 has a pair of vertically aligned pin apertures 60 and is adapted to receive terminal end 50 of longitudinal frame member 48 in pivoting engagement. Transverse carrier member 58 and longitudinal frame member 48 are interconnected with a pivot pin or bolt 62 (FIGS. 5 and 8).

Figure 3:
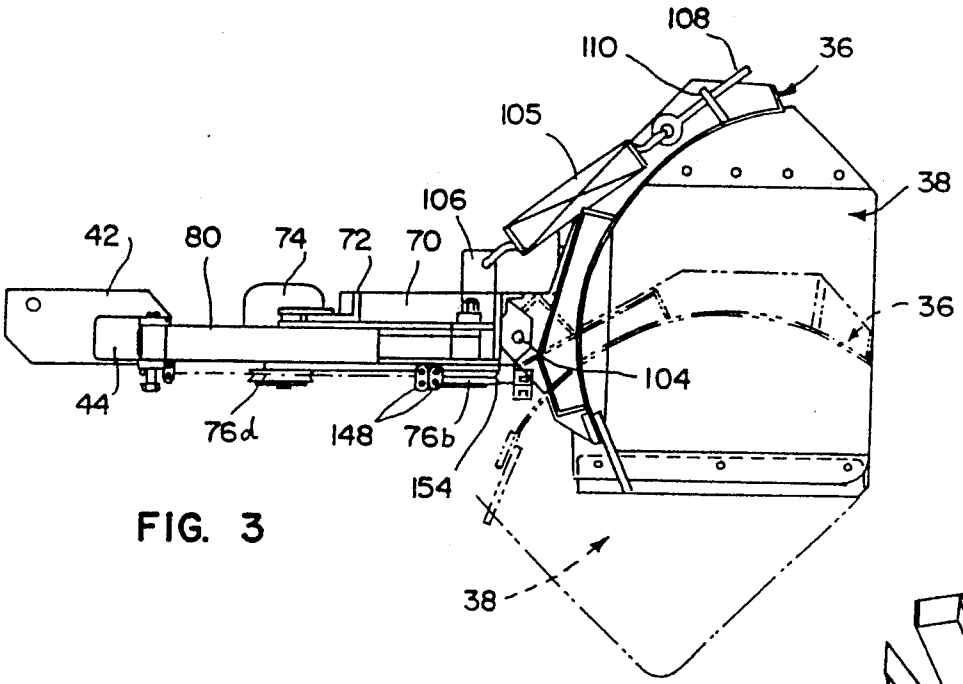
FIG. 3 is a right side elevational view of the plow assembly of FIG. 1, showing in phantom, rotation of the plow blade about a horizontal axis to a tripped position.

Transverse carrier member 58 has opposing left 64 and right 66 ends (FIGS. 2 and 5). Upper frame members 68 and 70 extend rearwardly and generally inwardly toward each other from opposing ends 64 and 66 of transverse carrier member 58 and terminate by connection with a slide plate 72, forming triangular upper frame 54. Slide plate 72 is captured in sliding engagement under a hook 74 which projects upward from a top surface of longitudinal frame member 48 (FIG. 3). Hook 74 thus restrains plow blade 36 and plow carrier 34 from pivoting vertically downwardly about pivot pin 62 and the end of frame member 48.

Lower frame member 56 may be a single, generally trapezoidal-shaped plate, extending generally rearward from transverse carrier member 58 (FIGS. 2 and 5). Cable sheaves or guides, but most preferably pulleys 76, are rotatably mounted under and at each corner of lower frame member 56 (FIGS. 2 and 5).

A power rotation device is preferably provided for horizontally rotating plow carrier 34, and plow blade 36 when mounted thereon, relative to support frame 32. This rotation device may be implemented in a number of ways, but preferably includes a pair of hydraulic cylinders 78 and 80 (FIG. 2). Various commonly available hydraulic cylinders may be used and cylinders having a 1.5 inch (3.80 cm) rod and a 9.83 inch (25 cm) stroke have been found to perform satisfactorily. One of cylinders 78 and 80 is positioned on each of two opposing sides of a subassembly formed by plow carrier 34 being rotatably mounted to support frame 32 as described above.

Cylinder 78 is preferably mounted with its head end pivotally connected at a left end 82 of support frame cross member 44 (FIG. 2). The opposing rod end of cylinder 78 is pivotally connected with transverse carrier member 58 at a location 79 about midway between terminal end 50 of longitudinal frame member 48 and left end 64 of transverse carrier member 58. Cylinder 80 is likewise pivotally connected between a right end 84 of frame cross member 44 and a location 81 along transverse carrier member 58, about midway between longitudinal frame member 48 and right end 66 of transverse carrier member 58.

Figure 17:
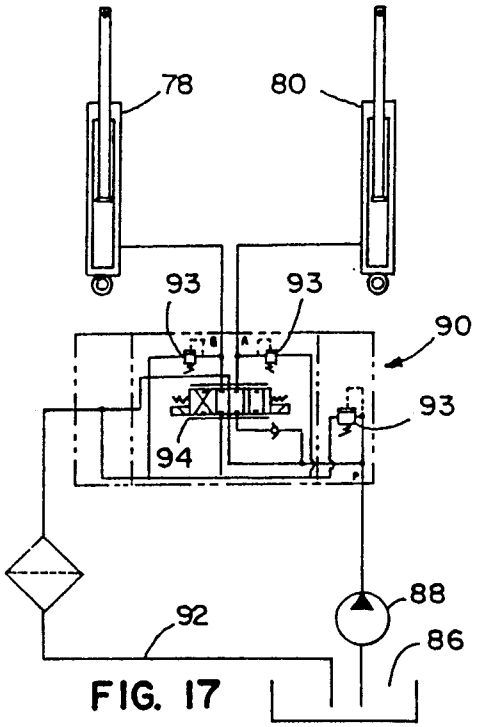
FIG. 17 is a schematic drawing of a hydraulic cylinder rotating device for use with the plow assemblies of the present invention using a spool valve with single acting cylinders.
Figure 19:
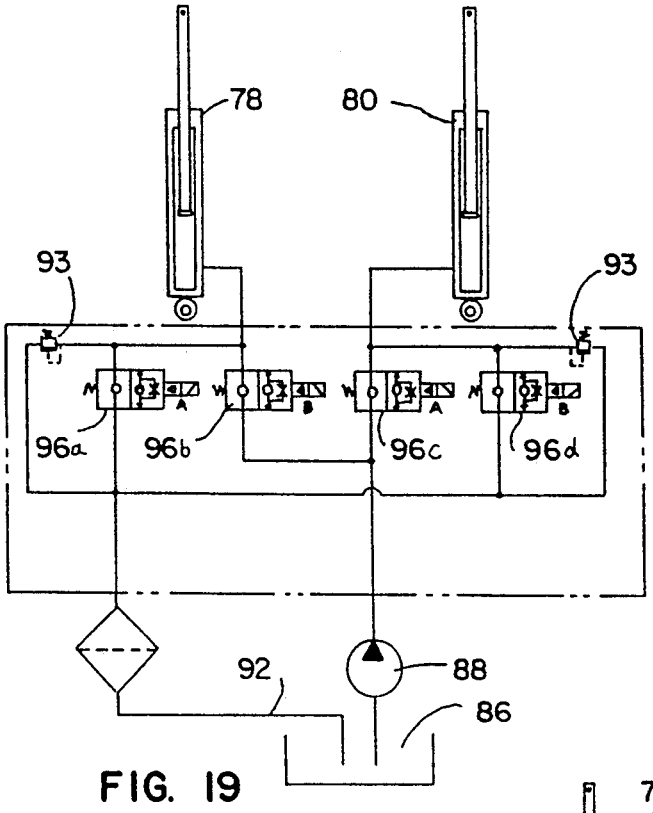
FIG. 19 is a schematic drawing of a second alternative embodiment of the hydraulic cylinder rotating device using poppet valves with single acting cylinders.
Figure 18:
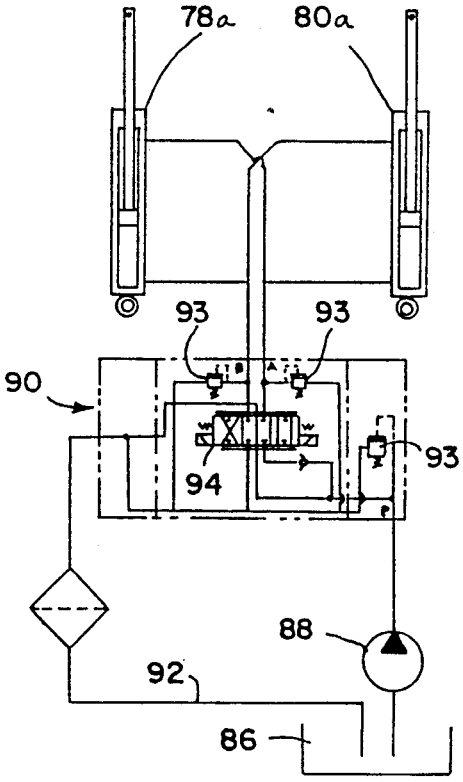
FIG. 18 is a schematic drawing of an alternative embodiment of the hydraulic cylinder rotating device using a spool valve with double acting cylinders.

As shown in FIGS. 17–19, various common hydraulic power systems may be used with the hydraulic cylinders 78, 80. Each hydraulic power system includes a hydraulic fluid reservoir 86, power pump 88, control valving 90, and interconnecting hydraulic lines, including a return line 92 to the reservoir. Each of these hydraulic power systems further includes commonly known pressure relief valves 93 in the hydraulic fluid circuit as is commonly known.

FIG. 17 shows a system incorporating single acting cylinders 78 and 80 and a spool valve 94. Spool valve 94 may be any of various control valves commonly available, including a Gresen V20 open center directional control valve having three-position, four-way solenoid operation with the spool blocked in neutral and both port and main reliefs for example. As described in greater detail below, regarding FIG. 22, an operator may select left or right rotation of plow blade 36 to a desired angled position. In the arrangement of FIG. 17, if the operator selects a left rotation of blade 36, spool valve 94 directs hydraulic fluid from pump 88 to the head end of single acting cylinder 80 to extend the rod of cylinder 80. While plow blade 36 thusly rotates to the left, single-acting cylinder 78 is compressed by this rotation and hydraulic fluid is pressed out of cylinder 78, through control valve 94 and return line 92 to reservoir 86. Conversely, if the operator selects a rotation of plow blade 36 to the right, control valve 94 directs hydraulic fluid to the head end of cylinder 78 to extend the rod of cylinder 78, rotating plow blade 36 and compressing cylinder 80, which expels hydraulic fluid through control valve 94 and return line 92 to reservoir 86.

FIG. 18 shows a system incorporating the same spool valve 94 as in FIG. 17, but used with double-acting cylinders **78*a* and 80*a*. In this arrangement, when the operator selects a rotation of plow blade 36 to the left, control valve 94 directs hydraulic fluid to the head end of cylinder 80*a* and rod end of cylinder 78*a*. Thus, while the rod of cylinder 80*a* is extended, the rod of cylinder 78*a* is retracted, not merely compressed in contrast to the system of FIG. 17, and cylinder 78*a* pulls plow blade 36 while cylinder 80*a* pushes plow blade 36, both in a left-hand rotation of plow blade 36. While the rod of cylinder 80*a* extends and the rod of cylinder 78*a* retracts, fluid is expelled from the rod end of cylinder 80*a* and from the head end of cylinder 78*a*. The expelled fluid flows through control valve 94 and return line 92 to reservoir 86. Selection of a right-hand rotation by the operator substantially reverses this function with control valve 94 directing fluid to the head end of cylinder 78*a* and the rod end of cylinder 80*a*. Fluid is then expelled from the rod end of cylinder 78*a* and the head end of cylinder 80*a*, flows through control valve 94, and return line 92 to reservoir 86**.

FIG. 19 shows a system incorporating the same single-acting cylinders 78 and 80 as in FIG. 17, but used with control valving having commonly known poppet valves **96*a–d*. When an operator selects a left rotation in this arrangement, poppet valves 96*a* and 96*c* are opened. Fluid is directed to the head end of cylinder 80 through valve 96*c* from pump 88. As with the system of FIG. 17, while the rod of cylinder 80 extends, the rotation of plow blade 36 compresses the rod of cylinder 78 and expels fluid from cylinder 78 which flows through valve 96*a* and return line 92 to reservoir 86. Conversely, the operator may select a right rotation of plow blade 36, opening poppet valves 96*b* and 96*d* to direct fluid to the head end of cylinder 78 through valve 96*b*. While the rod of cylinder 78 extends and plow blade 36 rotates to the right, the rod of cylinder 80 is compressed, expelling fluid through valve 96*d* and return line 92 to reservoir 86**.

In each of the systems shown in FIGS. 17–19, hydraulic power pump 88 is typically not continuously energized and preferably only runs when actually required for hydraulic power to move plow blade 36. This minimizes the amount of power drawn from the plow vehicle.

As shown in FIG. 2, a second set of parallel pivot plates 100 project forward from transverse carrier member 58 and are adapted for coupling with pivot members 102 provided on plow blade 36. Pivot plates 100 and pivot members 102 are adapted to receive coaxial pivot pins or bolts (not shown) which interconnect pivot plates 100 with pivot members 102 in a hinge-like manner along a common, generally horizontal pivot axis or "trip" axis 104 (FIGS. 3 and 8).

Plow blade 36 and plow carrier 34 are thus pivotally interconnected for generally horizontal rotation of the plow blade and rotation of the plow blade about horizontal trip axis 104, between a generally vertical or normal plowing position and a generally horizontal or tripped position, shown in phantom in FIG. 3. During many plowing conditions, the lower edge of the plow blade may encounter a protrusion from a surface to be cleared, such as a parking stop, curb, or uneven cement joint for example. This tripping rotation about trip axis 104 allows the blade to rotate forward and present an inclined surface to the protrusion so that in conjunction with the pivotal connection of support frame 32 with the plow vehicle, plow blade 36 will "ramp" up and over the protrusion, rather than remain in the generally vertical position. If, however, plow blade 36 were not allowed to trip, a significant force may be imparted to the blade through the protrusion and damage to plow assembly 30 or the plow vehicle may result.

Plow blade 36 is biased toward the normally, generally vertical position by trip or bias springs 105 which interconnect between plow carrier 34 and the blade, near the top of the blade (FIGS. 2, 3, and 8). At one end of each trip spring 105, the springs hook through apertures provided in spring plates 106 which extend generally vertically upwardly from transverse carrier member 58 (FIG. 3). At an opposing end of each trip spring 105, the springs hook through the eye of an eye bolt 108 which in turn extends through an aperture provided in a plate 110 which projects rearwardly from plow blade 36, near the top of the blade (FIGS. 2 and 3). The interconnection of trip springs 105 with plow blade 36 through eye bolts 108 allows pretension adjustment of the springs to vary the biasing force exerted by the springs.

Figure 6:
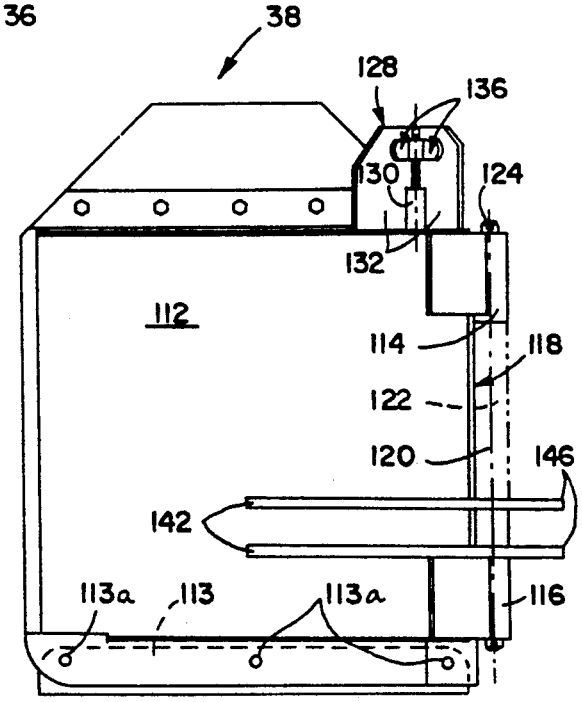
FIG. 6 is an outside elevational view of the left wing.
Figure 7:
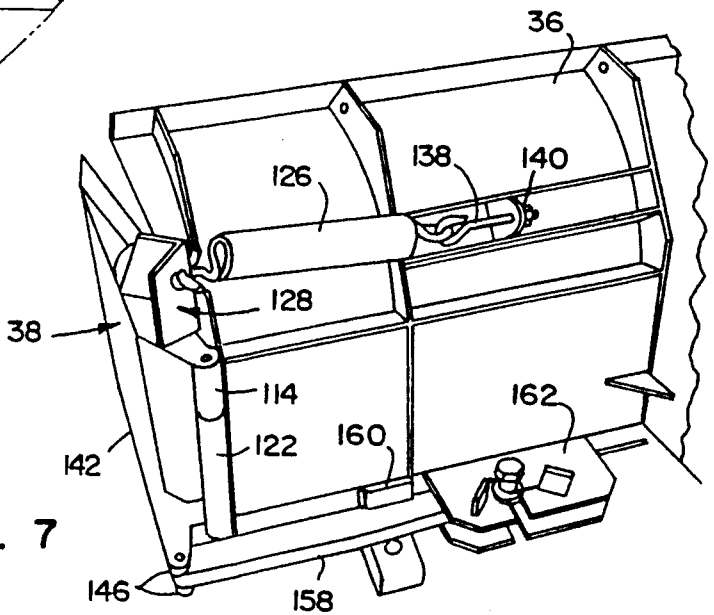
FIG. 7 is a fragmentary perspective view of the left end of the plow blade of FIG. 1.
Figure 16:
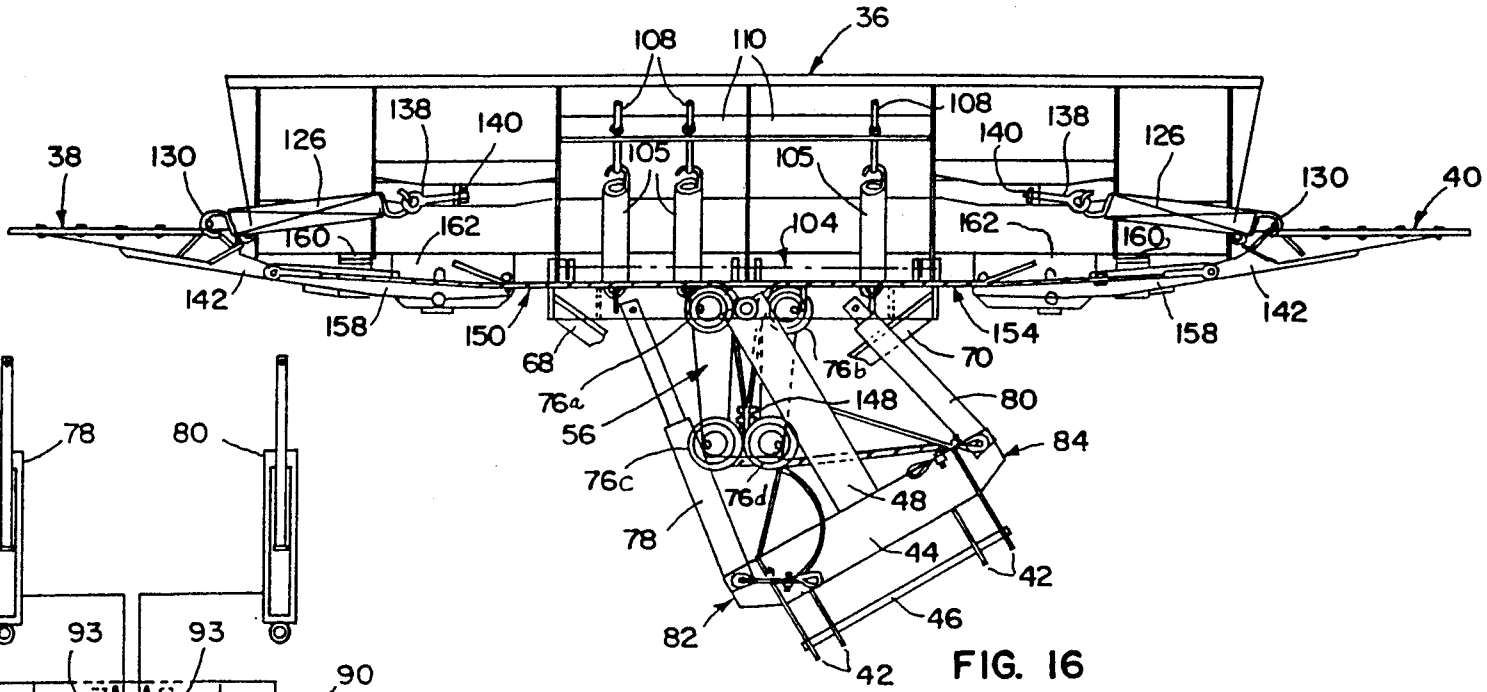
FIG. 16 is a partial fragmentary top plan view of the plow assembly of FIG. 1 with the plow blade rotated substantially off center to a fully angled position and the wings open.

Blade wings 38 and 40 are pivotally connected with plow blade 36 at each end of the blade (FIGS. 2, 8, and 16). As shown in FIG. 6, each wing 38, 40 has a blade portion 112. A wear strip 113 is fastened along a lower edge of blade portion 112 by fasteners 113*a*. Fasteners 113*a* are mounted in apertures which may be elongated to allow vertical adjustment of wear strip 113 to accommodate wear along its lower edge. Wear strip 113 is preferably made from ultra high molecular weight (UHMW) polyethylene, but may be of any material, suitable for protecting the wing 38, 40 from excessive wear. Vertically spaced upper and lower pivot sleeves 114, 116 are provided along a rear edge 118 of blade portion 112 (FIG. 6). Pivot sleeves align along a common, vertical pivot axis 120 so that a cooperating plow blade pivot sleeve 122, provided on each end of plow blade 36, may be interposed between the pivot sleeves 114, 116 for pivotable connection of each wing 38, 40 with plow blade 36 (FIG. 7). Each of the three pivot sleeves 114, 116, and 122 has a generally centered and vertically oriented bore which aligns coaxially along pivot axis 120 when pivot sleeve 122 is interposed between pivot sleeves 114 and 116. A corresponding pivot pin 124 is inserted through pivot sleeves 114, 116, and 122 to pin the wing to the plow blade in a hinge-like manner (FIGS. 6 and 7).

A wing bias spring 126 is provided to bias each wing 38, 40 toward a closed position wherein the wings project generally forward from plow blade 36, forming a generally U-shaped assembly (FIGS. 2, 7, and 8). In the closed position, wings 38, 40 bear tightly against the planar end surfaces of blade 36 to seal the ends and prevent escape or spill over of the material being plowed. When closed, wings 38, 40 each actually extend forwardly, but at a slight outward angle of about 9.6° as shown in FIG. 8.

A spring post 128 extends generally vertically upward from the top of blade 112 and is positioned forward of axis 120 (FIGS. 6 and 7). Spring post 128 is formed by a weldment of a piece of metal rod stock 130 and two pieces of plate stock 132 and 134 welded along the length of rod stock 130. The two pieces of plate stock 132 are oriented to define an approximately 90° angle between them (FIG. 2). A slot 136 is provided in each plate 132 to expose a portion of rod 130 so that one end of wing bias spring 126 is connected with spring post 128 by hooking an exposed portion of rod 130 (FIG. 6). As with the trip springs 104, wing bias springs 126 extend to an eye bolt 138 which interconnects with a fastening plate 140, on the back of plow blade 36 (FIGS. 2 and 7). Eye bolt 138 is provided to allow pretension adjustment of wing bias springs 126.

A pair of generally parallel and spaced apart arms 142 are also provided on each wing 38, 40, project generally outward from blade portion 112, extending along an outside surface portion of wing blade portion 112, and project rearward from the wing 38, 40, beyond pivot axis 120 (FIGS. 2, 6, and 7). Each wing 38, 40 may be rotated to an open position in which the wings project in generally opposite directions, away from each other, and effectively extend the length of the plow blade 36, by pulling projecting ends 146 of the arms 142 toward blade carrier 34 (FIGS. 2, 6, 7, and 16).

Figure 20:
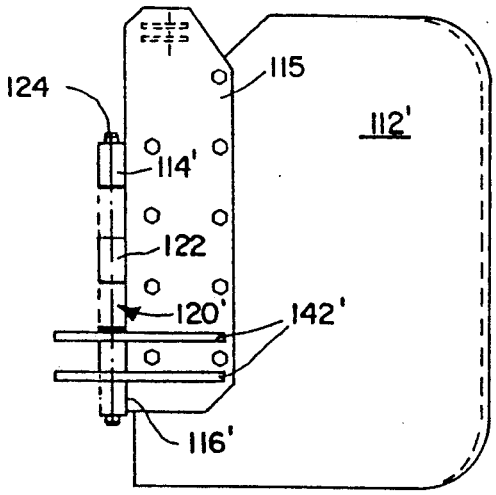
FIG. 20 is an outside elevational view of an alternative embodiment of the right plow wing.

Alternatively to plow wings 38 and 40 as described above, an all plastic wing may be used as shown in FIG. 20. The all plastic wing is preferably made from UHMW polyethylene, but may be made from any suitably durable plastic. As shown in FIG. 20, the all plastic wing has a plastic blade portion 112' fastened by bolting or riveting for example, with a mounting plate 115. Upper and lower pivot sleeves 114', 116' are provided along a rear edge of mounting plate 115. Wing arms 142' extend across mounting plate 115 and project rearward, beyond wing pivot axis 120'. Arms 142' may also extend forward over the outside surface of blade portion 112' for additional stiffening as required.

While a number of devices may be employed to pull the wings 38, 40 from the closed position to the open position, this is preferably accomplished by cabling connected with each arm 142 and extending along the back of plow blade 36 to engage pulleys 76 and attach to support frame 32, preferably at the ends 82 and 84 of cross member 44 (FIG. 2). Specifically as illustrated in FIGS. 2, 8, 12, and 16, a first length of cable 150 is connected at a first end with arms 142 of left wing 38 at ends 146, extends to and around pulleys 76*a* and 76*c*, and extends to left end 82 of support frame cross member 44 where the cable is connected by a conventional fastener near a second end. A loop 152 is formed at the second end of cable 150 for snugging the cable with a pry bar. Likewise, a second length of cable 154 is connected at a first end with arms 142 of right wing 40 at ends 146, extends to and around pulleys 76*b* and 76*d*, and is connected by a conventional fastener near a second end with the right end 84 of support frame cross member 44. A snugging loop 156 is also provided at the second end of cable 154. Cables 150 and 154 are clamped together with cable clamps 148, preferably clamping the cables 150, 154 near the pulleys 76*a*, 76*b*, between the pulleys 76*a*, 76*b* and the pulleys 76*c*, 76*d*.

As shown in the figures, specifically FIG. 3, this routing of cables 150 and 154, in conjunction with the positioning of pulleys 76*a* and 76*b* places the cables running generally parallel and closely adjacent to trip axis 104. This relation between cables 150 and 154 and axis 104 minimizes any potential to dislodge the cables 150, 154 from the pulleys 76*a*, 76*b* or to unduly stress the cables 150, 154 when plow blade 36 trips and rotates about trip axis 104.

While this specific routing of the cabling is shown in the figures and described, alternative cabling arrangements will be apparent to those who practice this invention. One may run a first cable between the wings 38, 40 and a second cable between the ends 82, 84 of support frame cross member 44 with these two cables routed to interconnect between pulleys 76*a* and 76*b* for example.

Thus, the specific cabling arrangement shown and described does not limit the scope of the invention which is defined by the claims.

Figure 11:
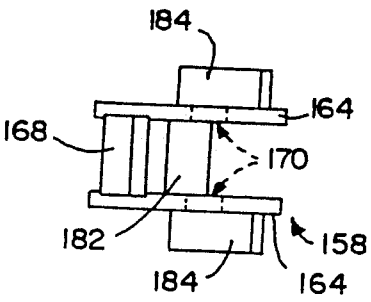
FIG. 11 is an end elevational view of the latch arm as indicated by sight lines XI—XI in FIG. 10.

Referring now to FIGS. 2, 7, and 9–11, a latching mechanism, including a latch arm 158, a wing closed stop plate 160, and a latch arm guide block 162, is provided on the rear of plow blade 36 adjacent each blade wing 38, 40 to latch the blade wings in the closed position. Latch arm 158 is a generally U-shaped channel member or weldment having upper and lower flange plates 164 with an interconnecting web plate 168 holding the flange plates 164 in spaced and generally parallel relationship (FIGS. 9, 10, and 11). Each flange plate 164 is substantially identical having a first aperture 170 near one end 172, a closed stop notch 174 defined midway along a forward facing edge, and a second aperture 178 near a second end 180. A cable sheave 182 extends between the two flange plates 164 and is positioned in alignment with second aperture 178. Sheave 182 may be a short length of steel tubing, round bar stock, or the like welded or otherwise connected between the flange plates 164. A wing open stop 184 is mounted on an outside surface of each flange plate 164. The stops 184 align with each other and project generally away from each other.

A pivot pin or bolt 186 pivotally connects latch arm 158 at its first end 172 between projecting ends 146 of the wing arms 142 of each blade wing 38 and 40 (FIG. 9). Latch arm 158 extends across the back of plow blade 36 from wing arms 142 and is positioned in guide block 162.

Further to the cabling described above, the pivotable connections between the latch arms 158 and wing arms 142 also preferably serves as the connecting point for cables 150 and 154 which, more particularly, are preferably positioned between the upper and lower flange plates 164 of the latch arms 158. The cables 150, 154 then extend through the latch arms 158, between the upper and lower flange plates 164 and past cable sheave 182, with the cables 150, 154 positioned between plow blade 36 and cable sheave 182. With latch arm 158 positioned in guide block 162, the cables 50, 154 extend through guide block 162.

Figures 12, 13, 14, 15:
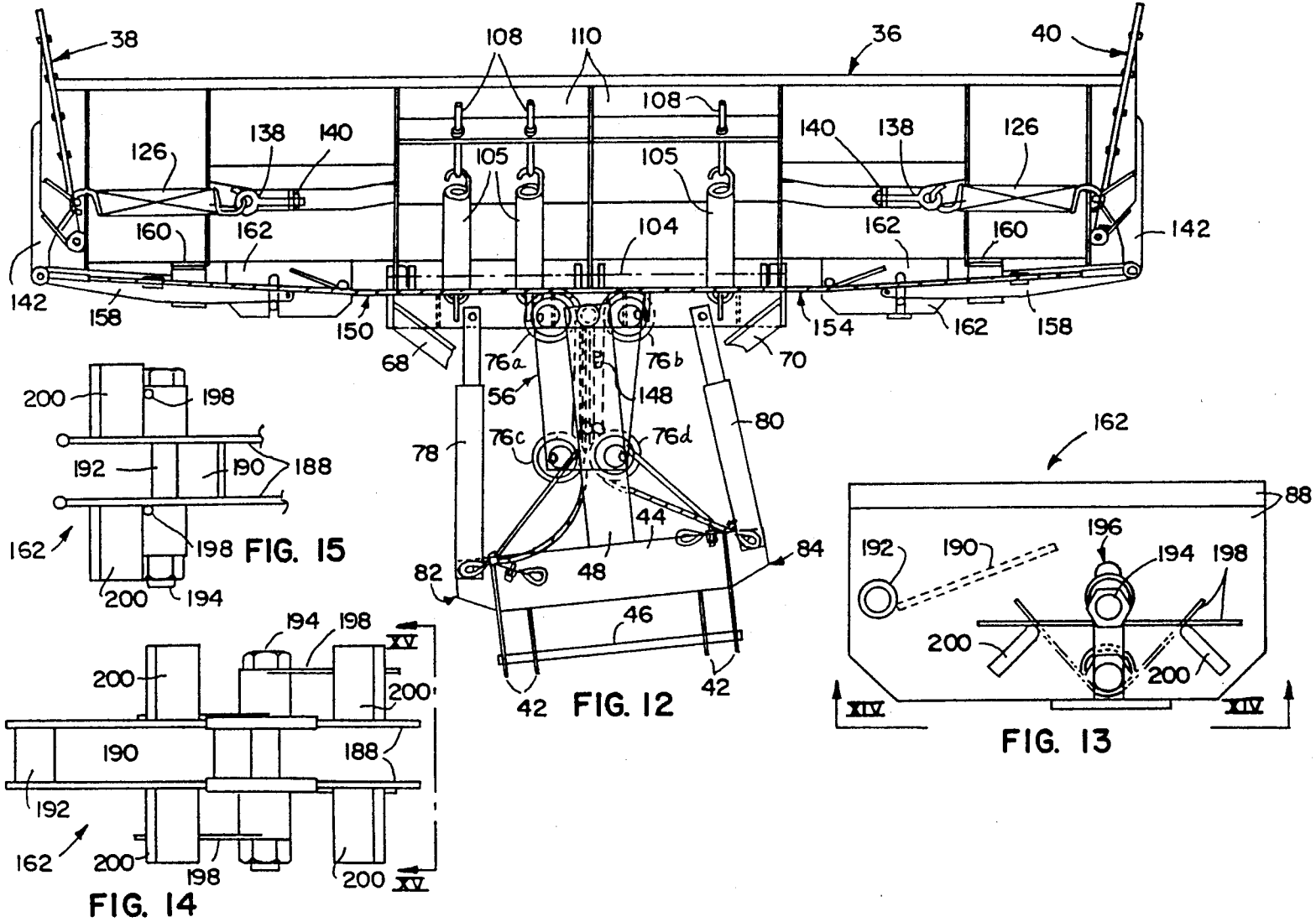
FIG. 12 is a partial fragmentary top plan view of the plow assembly of FIG. 1 with the plow blade in a slightly off center, angled position.
FIG. 13 is a top plan view detail of a latch block of the plow assembly as indicated by sight lines XIII—XIII in FIG. 9.
FIG. 14 is a rear elevational view of the latch block of FIG. 13 as indicated by sight lines XIV—XIV in FIG. 13.
FIG. 15 is an end elevational view of the latch block as indicated by sight lines XV—XV in FIG. 14.

A guide block 162 projects rearwardly from the back of plow blade 36 near each of the left and right ends of plow blade 36 (FIGS. 2, 7, 8, 9, 12, and 13). Each guide block 162 includes generally parallel and spaced apart upper and lower plates 188, a deflector plate 190 extending generally perpendicularly between upper and lower plates 88, and a cable sheave 192 located at one end of deflector plate 190 and also extending generally perpendicularly between upper and lower plates 188 (FIGS. 13–15). A retainer pin or bolt 194 is provided for retaining latch arm 158 in guide block 162. Retaining pin 194 is positioned in slots 196 in each of the upper and lower plates 188. Retaining springs 198 are provided at each of two opposing ends of retaining pin 194 to bias the retaining pin and in turn latch arm 158 toward plow blade 36. A pair of spring blocks 200 are provided on each of the upper and lower plates 188. Retaining springs 198 bear against blocks 200 for biasing retaining pin 194 toward plow blade 36.

In operation, cables 150 and 154 are preferably slightly slack when plow blade 36 is in the centered or a generally centered position (FIG. 8). As plow blade 36 is rotated off-center to the right for example (FIG. 12), pulleys **76*c* and 76*d* move toward the left of longitudinal frame member 48, pulling right cable 154 tight while left cable 150 further slackens. However, since cables 150 and 154 are tied together by cable clamps 148, the tightening right cable 154 also pulls a portion of left cable 150, between cable clamps 148 and left blade wing 38, tight. As plow blade 36 is rotated farther off-center (FIG. 16), cable 154 and the portion of cable 150 continue to tighten, pulling blade wings 38, 40 against the biasing force of springs 126. Because cables 150 and 154 run through latch arms 158 and guide blocks 162 and between cable sheaves 168 and 192, the second end 180 of each latch arm 158 is pulled away from plow blade 36, against the biasing force of springs 198 acting against pins 194, pulling closed stop notches 174 away from closed stop plate 160 and releasing latch arms 158, as the cables 150, 154 tighten. While plow blade 36 continues to rotate substantially away from the centered position, pulley 76*d* continues to pull on right cable 154, in turn pulling on both cables and both wing arms 142, and rotates the blade wings 38, 40 to the open position (FIG. 16). The extension of wings 38 and 40 to the open position is limited by wing open stops 184 engaging the upper and lower plates 188 of guide blocks 162**.

This process reverses itself as the plow blade 36 is returned to the centered position, pulley **76*d* swings back over and adjacent to longitudinal frame member 46, and the right cable is released to its slackened position. As right cable 154 is released, tension in cables 150 and 154 pulling on the blade wing arms 142 is released and wing bias springs 126 pull the wings 38, 40 back to the closed position. Further, tension is relieved in cables 150 and 154, the cables slacken and retaining springs 198 bias retaining pins 194 in each guide block 162 toward plow blade 36, relocking latch arms 158 by the engagement of closed stop notches 174 with closed stop plates 160**.

Figure 21:
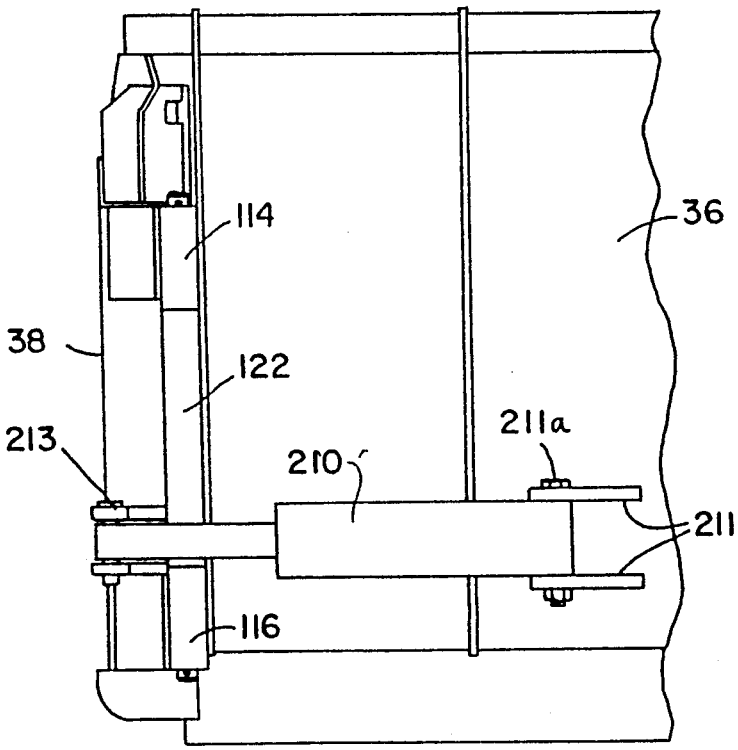
FIG. 21 is a fragmentary rear elevational view of the left end of a second embodiment of the plow blade showing an alternative embodiment of the actuator.

In the alternative to the cabling 150, 154, latching mechanism, including latch arms 158 and guide blocks 162, and lower plow carrier frame member 56 with pulleys 76, an actuator comprising a mechanical power source for opening and closing wings 38, 40 and a control responsive to the position of plow blade 36 relative to support frame 32 may be used. According to this alternative embodiment, shown in FIGS. 21–25, each of a pair of hydraulic cylinders 210 has a head end pivotally connected via support plates 211 and pivot pin **211*a* with plow blade 36 and has a rod end pivotally connected via pivot pin 213 with wing arms 142 of each wing 38 and 40 (FIGS. 21–23). cylinders 210** are preferably 5.46 inch (13.87 cm) stroke double-acting cylinders having a 1.38 inch (3.5 cm) rod and a 2.5 inch (6.35 cm) bore. However, those who practice this invention may find other commonly available hydraulic cylinders to perform satisfactorily.

Figure 22:
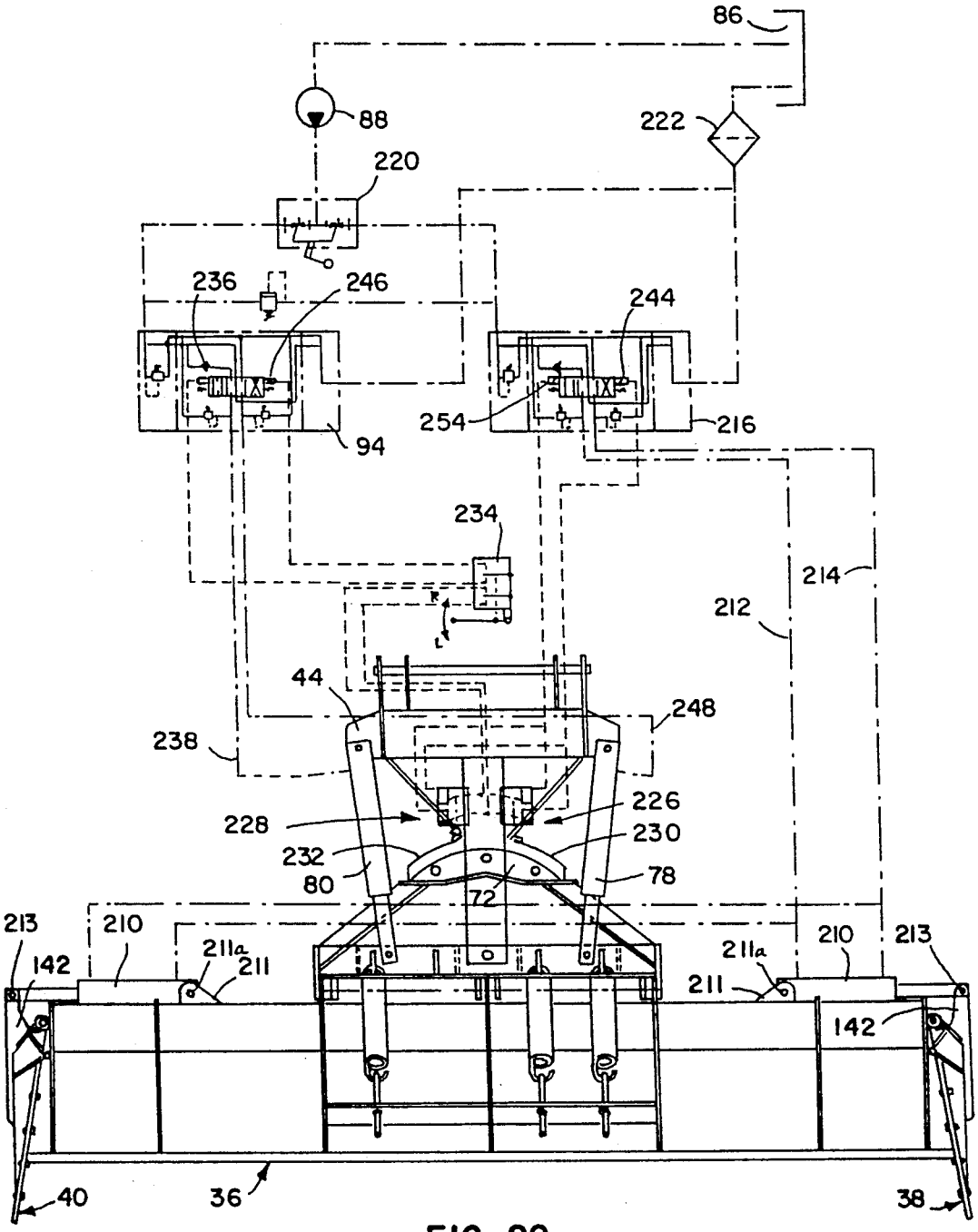
FIG. 22 is a partial schematic top plan view of a second embodiment of the plow assembly showing an alternative embodiment of the actuator.
Figure 24:
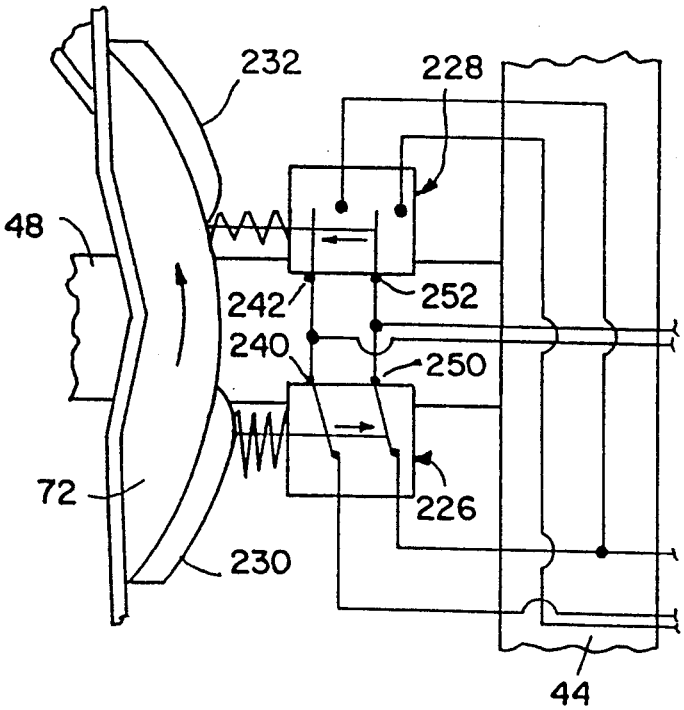
FIG. 24 is the schematic detail of FIG. 2 with the plow blade rotated off-center to the left.
Figure 25:
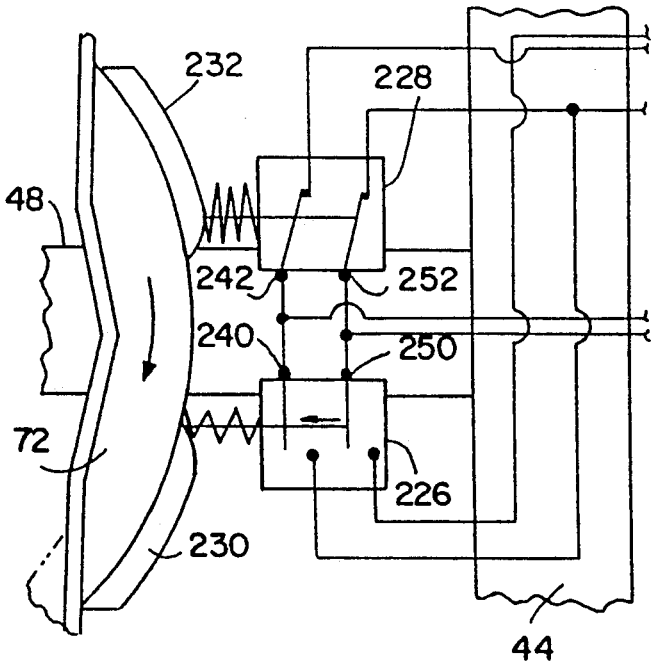
FIG. 25 is the schematic detail of FIG. 24 with the plow blade rotated off-center to the right.

Cylinders 210 are connected in parallel through hydraulic lines 212 and 214 with a spool valve 216 (FIG. 22). As with spool valve 94, discussed above, spool valve 216 may be any of various control valves commonly available, including a Gresen V20, open center directional control valve having three-position, four-way solenoid operation with the spool blocked in neutral and both port and main reliefs for example. Hydraulic fluid is supplied to spool valve 216 through pump 88 and a proportional diverter 220. Hydraulic fluid returning through spool valve 216 from cylinders 210 passes through filter 222 to reservoir 86. Spool valve 216 is also electrically connected with a pair of cam operated limit switches 226 and 228 which are wired in parallel and follow cams 230 and 232, respectively, provided on slide plate 72. The limit switches are preferably weather proof and may each be double pole, single throw designs or have two single pole, double throw circuits, such as in the Micro-Switch brand environment proof limit switch model 1CH1-6.

As shown in FIG. 22, the limit switches 226, 228 are connected with an operator switch 234 which also controls the hydraulic circuit and spool valve 94 for controlling rotation of plow blade 36. Operator switch 234 may be any of various double pole, double throw switches which are commonly available, including the Cutler Hammer model 8511-K2. While the blade rotation hydraulic circuit of FIG. 17 is shown in FIG. 22, the circuits of FIGS. 18 and 19, or other commonly known hydraulic circuits serving the same function, may be satisfactorily substituted in FIG. 22.

Figure 23:
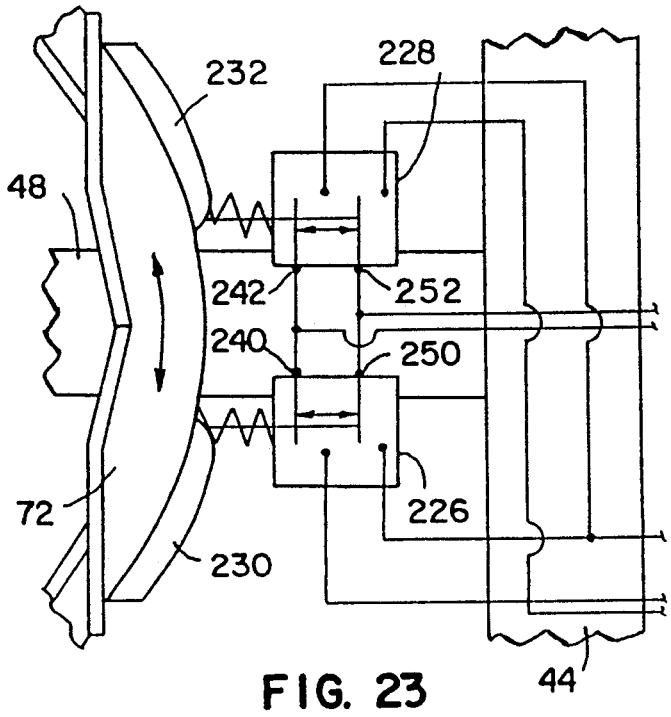
FIG. 23 is a schematic detail of the limit switches of FIG. 22.

In operation, plow blade 36 is angled left from the centered position when an operator manipulates switch 234 to a left position "L", energizing coil 236 of valve 94 to direct hydraulic fluid to cylinder 80 through line 238 (FIG. 22). Manipulating switch 234 to the left position also energizes contacts 240 and 242 of the limit switches 226, 228, respectively (FIGS. 22 and 23). While plow blade 36 swings left, slide plate 72 swings cams 230 and 232 past limit switches 226 and 228, respectively. Switch 228 follows cam 232 toward slide plate 72 and keeps its contacts open, but switch 226 follows cam 230 away from slide plate 72 and closes its contacts. Thus, coil 244 of spool valve 216 is energized through limit switch 226 as the limit switch follows cam 230 and spool valve 216 directs hydraulic fluid to the rod end of cylinders 210 to retract the cylinder rods and rotate the wings 38, 40 to the open position. Flow divider 220 is preferably adjusted so that the wings 38, 40 will fully open prior to plow blade 36 being fully angled to the left.

The plow blade 36 may be rotated to the right from the left position by manipulating operator switch 234 to a right position "R" and energize coil 246 of valve 94 to direct hydraulic fluid to cylinder 78 through line 248. With operator switch 234 in the right position, contacts 250 and 252 of limit switches 226, 228, respectively, are also energized. Since the contacts in switch 226 are closed, coil 254 of spool valve 216 is now energized and spool valve 216 directs hydraulic fluid through line 212 to the head end of each cylinder 210 to extend the cylinder rods and rotate the wings 38, 40 to the closed position.

While plow blade 36 swings right to the centered position, slide plate 72 swings cams 230 and 232 past limit switches 226 and 228, respectively. Switch 228 does not engage cam 232 until plow blade 36 swings past the centered position to a right angled position, thus the contacts of switch 228 remain open until after the centered position is obtained. However, switch 226 follows cam 230 and keeps its contacts closed until plow blade 36 approaches the centered position. When plow blade 36 rotates to a generally centered position, switch 226 follows cam 230 toward slide plate 72, opening its contacts. Thus, in the generally centered position, neither coil 254 or 244 of solenoid valve 216 are energized.

The plow blade 36 may continue to rotate to the right or initially be rotated to the right from the centered position by having the operator switch 234 in the right position "R". This energizes coil 246 of solenoid valve 94 to direct hydraulic fluid through line 248 to cylinder 78.

This also energizes contacts 250 and 252 of limit switches 226 and 228, respectively. Again, slide plate 72 and cams 230 and 232 swing past limit switches 226 and 228, respectively, while plow blade 32 swings to the right. Switch 226 follows cam 230 towards slide plate 72 and keeps its controls open, but switch 228 follows cam 232 away from slide plate 72 and closes its contacts. Thus, coil 244 of spool valve 216 is energized through limit switch 228 as the limit switch follows cam 232 and spool valve 216 directs hydraulic fluid to the rod end of each cylinder 210 to retract the cylinder rods and rotate the wings 38, 40 to the open position.

Manipulating the operator switch 234 to the left position "L" will eventually return plow blade 36 to the centered position by rotating the blade from right to left. Again, contacts 240 and 242 of limit switches 226 and 228, respectively, are energized when switch 234 is in the left position. However, since the plow blade 36 is initially starting from a right rotated position, the contacts of switch 226 are open and the contacts of switch 228 are closed so that coil 254 of spool valve 216 is now energized and spool valve 216 directs hydraulic fluid to the head ends of each cylinder 210 to extend the cylinder rods and rotate the wings 38, 40 to the closed position while plow blade 36 rotates from a right position to the center position.

Figure 26:
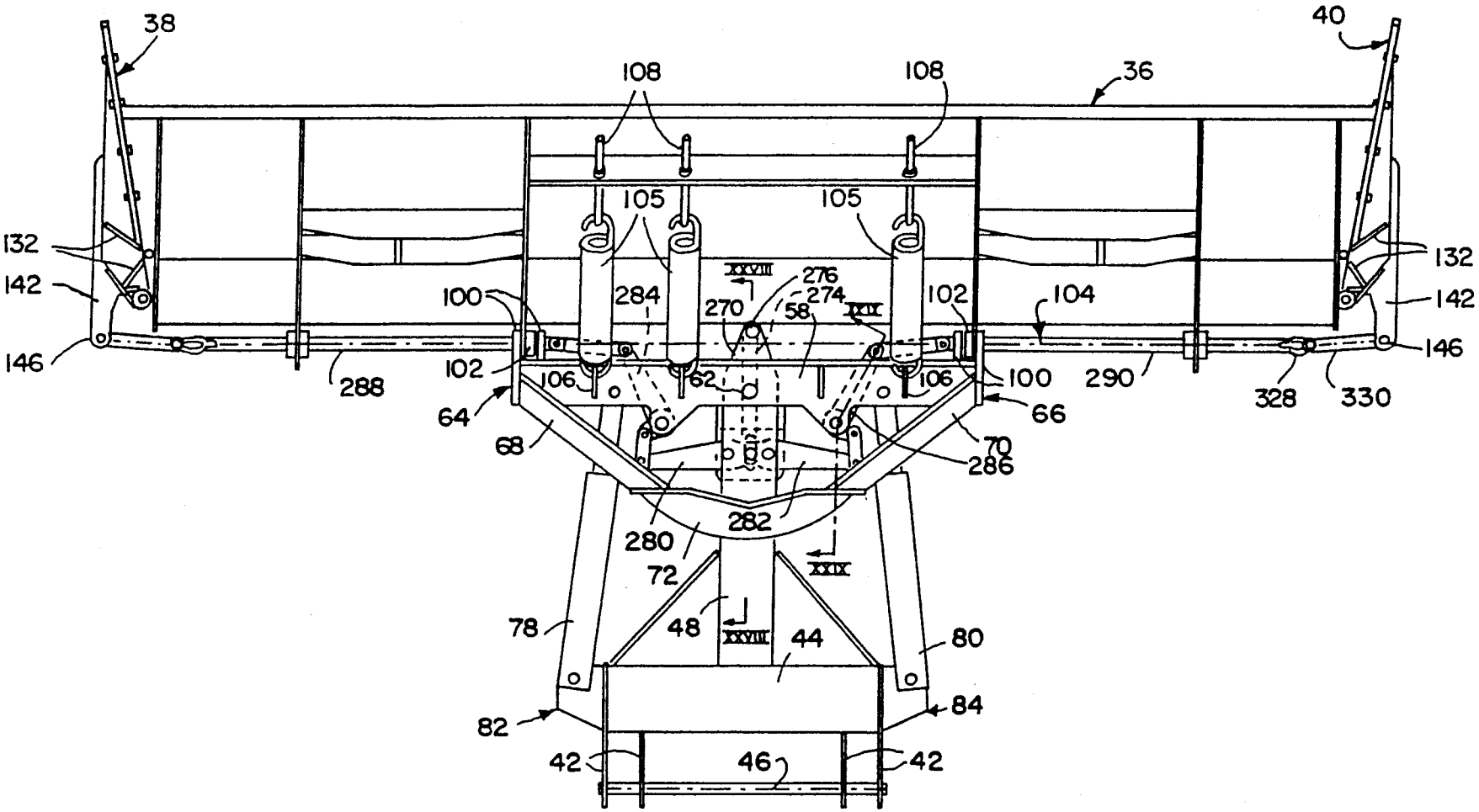
FIG. 26 is a top plan view of a third embodiment of the plow assembly showing a second alternative embodiment of the actuator.
Figure 27:
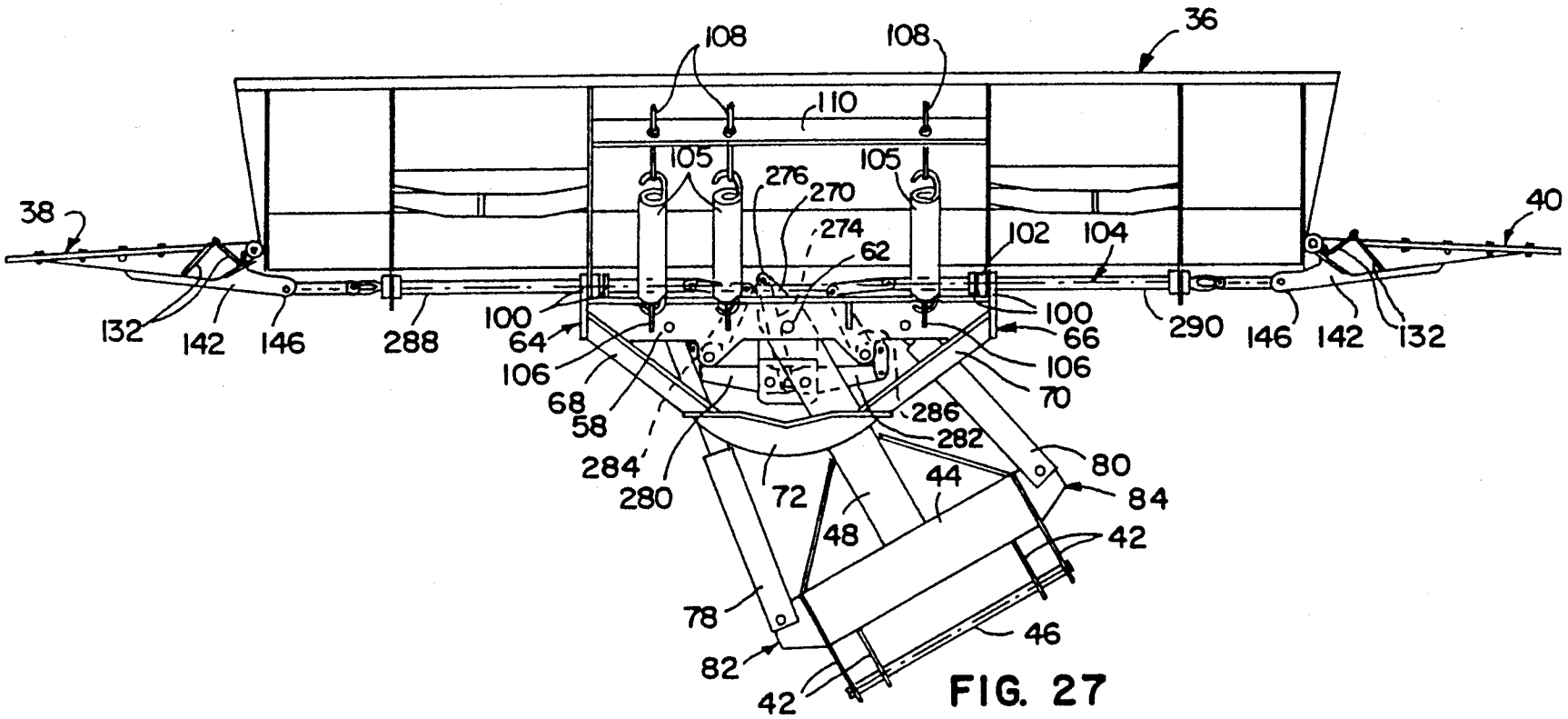
FIG. 27 is the top plan view of the plow assembly of FIG. 26 with the plow blade rotated substantially off-center to the right and the wings open.
Figure 28:
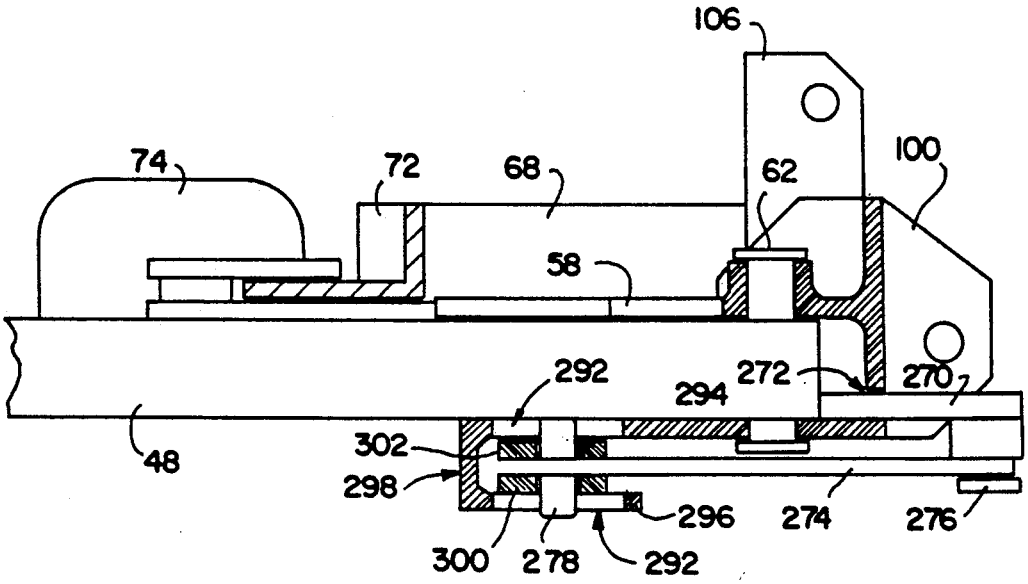
FIG. 28 is a partial elevational view, shown partly in section, taken along section line XXVIII—XXVIII of FIG. 26 with the plow blade removed.
Figure 29:
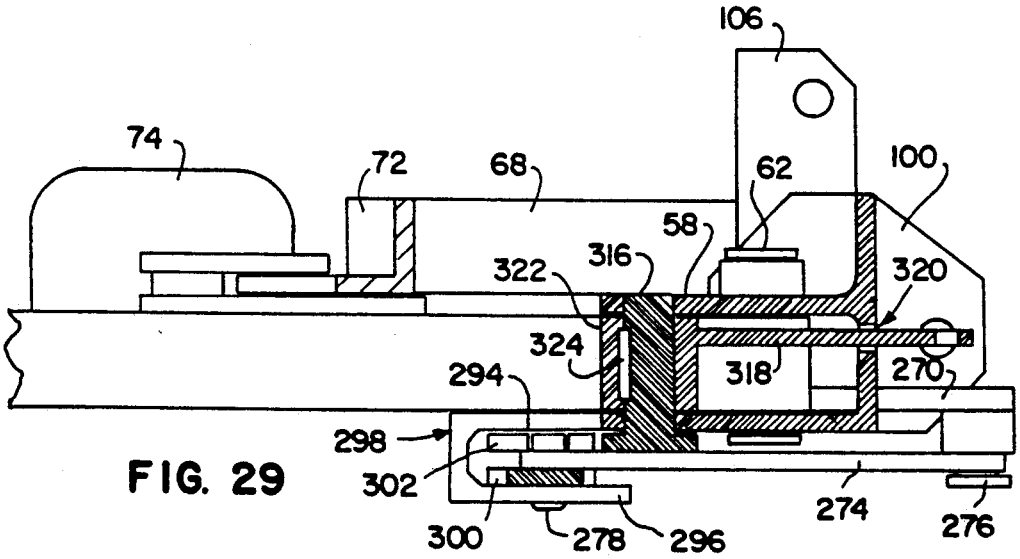
FIG. 29 is a partial elevational view, shown partly in section, taken along section line XXIX—XXIX of FIG. 26 with the plow blade removed.
Figure 30:
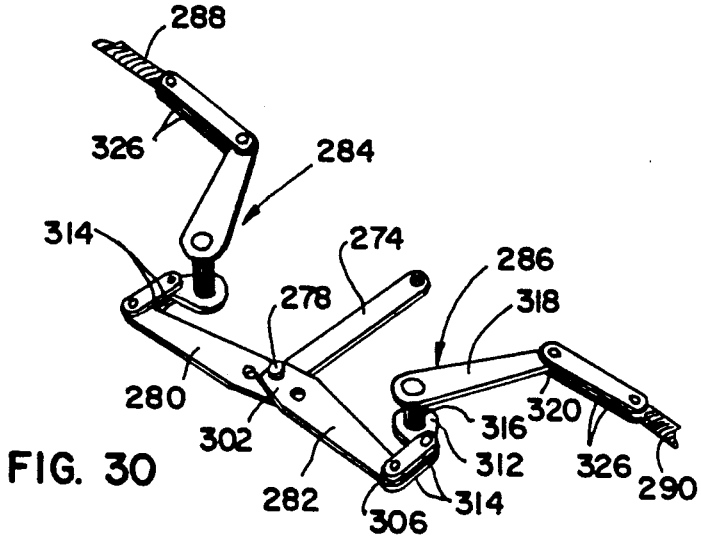
FIG. 30 is a rear perspective view of the second alternative embodiment of the actuator.

A second alternative embodiment of the actuator includes a series of mechanical linkages interconnecting each of wings 38, 40 with support frame 32 as shown in FIGS. 26–32. The actuator includes a link 274, a pair of toggle arms 280 and 282, a pair of bell cranks 284 and 286, and a pair of rod members 288 and 290 (FIGS. 26, 27, and 30).

Figure 32:
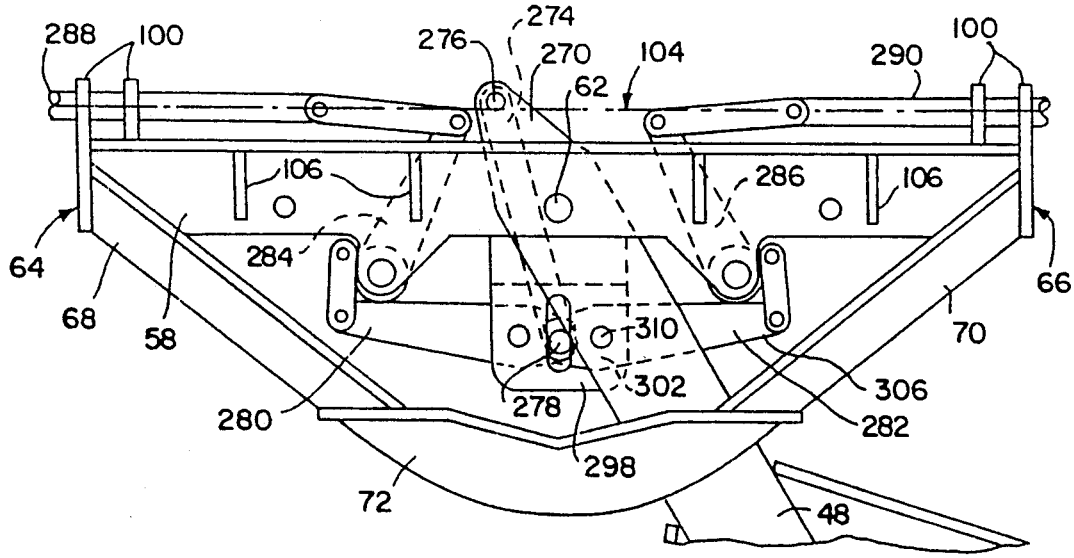
FIG. 32 is a top plan view of the plow carrier with the second alternative embodiment of the actuator and a fragment of the support frame.

In this embodiment, support frame longitudinal frame member 48 has an extension 270 which projects forward beyond plow carrier transverse carrier member 58, through a slot 272 (FIGS. 28 and 32). One end of link 274 is pivotally connected with longitudinal frame member 48 at the end of extension 270 by a pivot pin 276 or the like (FIGS. 32 and 28). Link 274 extends rearward from pivot 276 to a slide pin 278, which is located in a slot 292 (FIG. 28). Slot 292 has a generally forward-/rearward orientation and is formed in each of an upper flange 294 and lower flange 296 of a generally rearward extending channel portion 298 or lower frame member of plow carrier 34.

Figure 31:
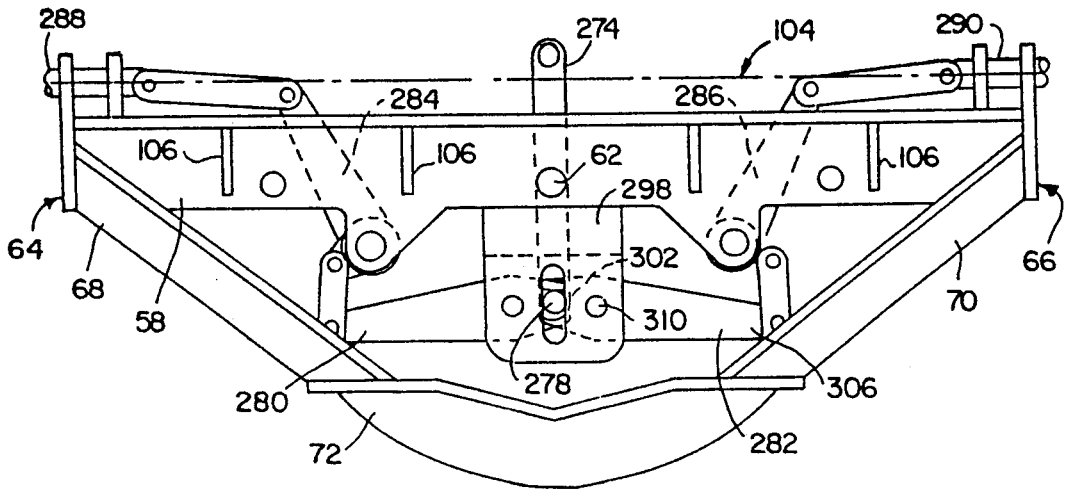
FIG. 31 is a top plan view of the plow carrier and second alternative embodiment of the actuator.

Because the left and right portions of the actuator are substantially mirror images of one another, only one side of the actuator will be discussed below with the understanding that the discussion will apply equally in mirror image to the other side of the actuator. Toggle arm 282 is an elongated member having a notched end 302, having a second end 306 opposite notched end 302, and being pivotally mounted in channel portion 298 by pivot 310 (FIGS. 31 and 32). Pivot 310 of toggle arm 282 is offset toward notched end 302 to define a relatively shorter lever arm between the pivot 310 and notched end 302 and a relatively longer lever arm between pivot 310 and second end 306 so that motion of notched end 302 is amplified at second en 306.

Second end 306 of toggle arm 282 is in turn connected with a short lever 312 of bell crank 286 by a pair of link plates 314. Link plates 314 are positioned on opposing sides of each of toggle arm 282 and lever 312 to sandwich the toggle arm and lever between the link plates. Further, link plates 314 are pivotally connected at one end with toggle arm 282 and pivotally connected at an opposing end with short lever 312.

Bell crank 286 is an assembly of short lever 312, a pivot shaft 316, and a long lever 318. The use of short lever 312 and long lever 318 provides amplification at an end 320 of long lever 318, away from pivot shaft 316, of motion transferred from link plates 314 to short lever 312. Bell crank 286 is pivotally mounted in transverse carrier member 58 with long lever 318 extending generally forward beyond transverse carrier member 58 through a slot 320 (FIG. 29). Pivot shaft 316 extends generally upward from short lever 312 through transverse carrier member 58 and long lever 318.

Long lever 318 may have a hub portion 322 which is keyed to shaft 316 by a key 324 Long lever 318 is connected at end 320 to rod member 290 by link plates 326 in the same manner that link plates 314 interconnect toggle arm 282 and short lever 312.

Rod member 290 extends across the back of plow blade 36 toward wing 40 (FIGS. 26 and 27). Further, rod member 290 extends coaxially along trip axis 104 to avoid any tendency to bind when blade 36 is tripped and rotates forward and downwardly about trip axis 104. Thus, rod member 290 is most preferably the hinge pin which interconnects plow carrier 34 and plow blade 36 through pivot plates 100 and pivot members 102. While rod member 290 may be torsionally preloaded to bias blade 36 toward its untripped vertical position, trip springs 105 are preferably used for this purpose as described above and rod member 290 is provided with a swivel joint 328 to avoid torsional loading (FIG. 26).

Rod member 290 is interconnected with wing 40 by a link 330 (FIGS. 26 and 27). Link 330 is pivotally connected at one end with wing arm end 146 and at a second end opposite the one end, with rod member 290. Further, swivel joint 328 (FIG. 26) may incorporate both the swivel joint function and the pivotal connection with link 330 in a single fitting.

In operation of the second alternative embodiment of the actuator including the series of mechanical linkages just described, plow blade 36 may be rotated from a generally centered position (FIG. 26) to an off-center or angled position (FIG. 27) by operation of cylinders 78 and 80 as discussed above. While plow blade 36 is rotated off-center toward the right for example, channel portion 298 moves to the left of longitudinal frame member 48 and the interconnection between link 274 and longitudinal frame member 48 causes slide pin 278 to move rearward relative to slot 292 and each of toggle arms 280 and 282. Thus, while slide pin 278 moves rearward, its interconnection with each of the toggle arms 280, 282 rotates toggle arm 280 clockwise and toggle arm 282 counterclockwise when viewed from above. The interconnection of toggle arm 280 with bell crank 284 in turn rotates bell crank 284 in a clockwise direction. Likewise, bell crank 286 is rotated in a counterclockwise direction by toggle arm 282. The rotation of each of the bell cranks 284 and 286 pulls rod members 288 and 290, respectively, inward, toward each other, along trip axis 104. Each of the rod members 288, 290 in turn pull on the wing arm end 146 of its respective wing 38 and 40, rotating wings 38 and 40 to the open position.

Rotating plow blade 36 from a right angled position toward the centered position substantially reverses the operation just described with the result that rod members 288 and 290 are pushed away from each other and push wing ends 146 generally outward to close wings 38, 40. Continued rotation of plow blade 36 past the centered position toward a left angled position swings channel portion 298 to the right of longitudinal frame member 48 with the result that slide pin 278 is again moved rearward in slot 292 by link 274 with the same result of the wings 38, 40 being rotated to the open position as discussed above relative to rotation of plow blade 36 to a right angle position.

The above description is considered that of the preferred embodiments only. It will be clear to those skilled in the art and to those who practice the invention that the embodiments of the invention described above may be modified, including modification to manipulate the wings 30, 40 independently for the best effect under various circumstances, such as opening only the trailing wing with the leading wing closed or only partially opened when plow blade 36 is rotated substantially off-center for example. Therefore, it is understood that the embodiments shown in the drawings and described above are merely for illustrative purposes and are not intended to limit the scope of the invention, which is defined by the following claims as interpreted according to the principles of patent law.

The embodiments of the invention in which an exclusive property or privilege is claimed are defined as follows.

1. A winged plow assembly for use with a vehicle, comprising:

a support frame adapted to pivotally connect with the vehicle and to extend away from the vehicle along a longitudinal centerline of vehicle, said support frame having a longitudinal axis oriented generally parallel with the vehicle centerline;

an elongated plow blade having two opposing ends and pivotally connected with said support frame to rotate generally horizontally between a centered position with said plow blade oriented generally perpendicular to said support frame longitudinal axis and a number of angled positions with said plow blade oriented at an angle relative to said support frame longitudinal axis;

a pair of plow blade wings, one of said pair of wings being pivotally connected with one end of said plow blade and the other of said pair of wings being pivotally connected with the opposing end of said plow blade, said wings rotating between a closed position in which said wings project generally forwardly, said wings and said plow blade defining a generally U-shaped assembly in said closed position so that said wings facilitate pushing material with said plow assembly, and an open position in which said wings project in generally opposite directions, away from each other to effectively extend the length of said plow blade so that said wings facilitate moving material to the side of the plow assembly; and actuator means responsive to the position of said plow blade relative to said support frame and connected with each of said plow blade wings for rotating said wings substantially simultaneously in opposite rotational directions, between said closed position when said plow blade is substantially in said centered position and said open position when said plow blade is rotated substantially away from said centered position.

2. The plow assembly defined in claim 1 wherein said actuator means includes at least one cable interconnecting at least one of said wings with said support frame to pull said wings into said open position when said plow blade is rotated substantially away from said centered position.

3. The plow assembly defined in claim 2 wherein said at least one cable includes a first cable portion operatively interconnecting said one of said pair of wings with said support frame to pull said one of said pair of wings to said open position when said plow blade is rotated substantially away from said centered position and a second cable portion operatively interconnecting said other of said pair of wings with said support frame to pull said other of said pair of wings to said open position when said plow blade is rotated substantially away from said centered position.

4. The plow assembly defined in claim 2 further including a biasing means connected between said plow blade and each of said wings for biasing said wings to said closed position.

5. The plow assembly defined in claim 2 wherein:

said plow blade is pivotally connected with said support frame for rotation of said plow blade about a generally horizontal axis between a normally generally vertical position and a generally horizontal position;

the plow assembly further includes trip biasing means for biasing said plow blade to said generally vertical position;

said cable has a first portion extending between one of said wings and said support frame and a second portion extending between the other of said wings and said support frame; and each of said first and second cable portions is positioned adjacent said horizontal axis.

6. The plow assembly defined in claim 5 further including a power rotation device for rotating said plow blade between said centered position and said angled positions.

7. The plow assembly defined in claim 6 wherein said power rotation device includes a pair of hydraulic cylinders, one of said cylinders being positioned along a first side of said support frame and connected between said support frame and said plow blade, a second of said cylinders being positioned along a second side of said support frame opposite said one cylinder and connected between said support frame and said plow blade.

8. The plow assembly defined in claim 1 wherein said actuator means includes at least one cable connected with each of said pair of wings and said support frame to pull said wings into said open position when said plow blade is rotated into one of said angled positions.

9. A winged plow assembly for use with a vehicle, comprising:

a support frame adapted to pivotally connect with the vehicle and to extend away from the vehicle along a longitudinal centerline of the vehicle, said support frame having a longitudinal axis oriented generally parallel with the vehicle centerline;

an elongated plow blade having two opposing ends and pivotally connected with said support frame to rotate generally horizontally between a centered position with said plow blade oriented generally perpendicular to said support frame longitudinal axis and a number of angled positions with said plow blade oriented at an angle relative to said support frame longitudinal axis;

a pair of plow blade wings, one of said pair of wings being pivotally connected with one end of said plow blade and the other of said pair of wings being pivotally connected with the opposing end of said plow blade, each said wing rotating between a closed position in which said wings project generally forwardly, said wings and said plow blade defining a generally U-shaped assembly in said closed position so said wings facilitate pushing material with said plow assembly, and an open position in which said wings project in generally opposite direction, away from each other to effectively extend the length of said plow blade so said wings facilitate moving material to the side of the plow assembly; and actuator means responsive to the position of said plow blade relative to said support frame for rotating at least one of said wings between said closed position when said plow blade is substantially in said centered position and said open position when said plow blade is rotated substantially away from said centered position, said actuator means including a latch for latching said wings in said closed position when said plow blade is substantially in said centered position and for releasing said wings from said closed position when said plow blade is rotated substantially away from said centered position.

10. The plow assembly defined in claim 1 wherein said plow blade is pivotally connected with said support frame for rotation of said plow blade about a generally horizontal axis between a normally generally vertical position and a generally horizontal position, and the plow assembly further includes trip biasing means for biasing said plow blade to said generally vertical position.

11. The plow assembly defined in claim 1 wherein said actuator means includes a mechanical power source and a control operatively connected with said mechanical power source, said power source being connected with at least one of said pair of wings to manipulate said at least one of said pair of wings between said open and closed positions, said control having a sensor responsive to the position of said plow blade relative to said support frame, said control sending an open signal to said mechanical power source when said plow blade is rotated substantially away from said centered position so said mechanical power source opens said at least one of said pair of wings and sending a close signal to said mechanical power source when said plow blade is substantially in said centered position so said mechanical power source closes said at least one of said pair of wings.

12. The plow assembly defined in claim 11 wherein said mechanical power source includes at least one hydraulic cylinder interconnected between said plow blade and at least said one wing.

13. The plow assembly defined in claim 12 wherein said mechanical power source includes said one hydraulic cylinder interconnected between said plow blade and said one wing and a second hydraulic cylinder interconnected between said plow blade and the other of said pair of wings.

14. The plow assembly defined in claim 1 wherein said actuator means includes a series of linkages operatively interconnecting at least one of said pair of wings with said support frame.

15. The plow assembly defined in claim 14 wherein said actuator means further includes a rod member operatively connected between said one of said pair of wings and said series of linkages.

16. The plow assembly defined in claim 15 wherein said plow blade is pivotally connected with said support frame for rotation of said plow blade about a generally horizontal axis between a normally generally vertical position and a generally horizontal position, and the plow assembly further includes trip biasing means for biasing said plow blade to said generally vertical position.

17. The plow assembly defined in claim 16 wherein said rod member extends coaxially along said horizontal axis.

18. The plow assembly defined in claim 1 wherein said actuator means includes a first series of mechanical linkages operatively interconnecting one of said pair of wings with said support frame and includes a second series of mechanical linkages operatively interconnecting a second of said pair of wings with said support frame.

19. The plow assembly defined in claim 18 wherein said plow blade is pivotally connected with said support frame for rotation of said plow blade about a generally horizontal axis between a normally generally vertical position and a generally horizontal position, and the plow assembly further includes trip biasing means for biasing said plow blade to said generally vertical position.

20. The plow assembly defined in claim 19 wherein said actuator means further includes a first rod member operatively connected between said one of said pair of wings and said first series of mechanical linkages and a second rod member operatively connected between said second of said pair of wings and said second series of mechanical linkages and wherein each of said first and second rod members extend coaxially along said horizontal axis.

21. A winged plow assembly for use with a vehicle, comprising:

a support frame adapted to pivotally connect with the vehicle and to extend away from the vehicle along a longitudinal centerline of the vehicle, said support frame having a longitudinal axis oriented generally parallel with the vehicle centerline;

an elongated plow blade having two opposing ends and pivotally connected with said support frame to rotate generally horizontally between a centered position with said plow blade oriented generally perpendicular to said support frame longitudinal axis and a number of angled positions with said plow blade oriented at an angle relative to said support frame longitudinal axis;

a pair of plow blade wings, one of said pair of wings being pivotally connected with one end of said plow blade and the other of said pair of wings being pivotally connected with the opposing end of said plow blade, each said wing rotating between a closed position in which said wings project generally forwardly, said wings and said plow blade defining a generally U-shaped assembly in said closed position so said wings facilitate pushing material with said plow assembly, and an open position in which said wings project in generally opposite directions, away from each other to effectively extend the length of said plow blade so said wings facilitate moving material to the side of the plow assembly;

actuator means responsive to the position of said plow blade relative to said support frame for rotating at least one of said wings between said closed position when said plow blade is substantially in said centered position and said open position when said plow blade is rotated substantially away from said centered position, said actuator means including at least one cable interconnecting said at least one of said wings with said support frame to pull said at least one of said wings into said open position when said plow blade is rotated substantially away from said centered position, said actuator means further including a latch for latching said wings in said closed position when said plow blade is substantially in said centered position and for releasing said wings from said closed position when said plow blade is rotated substantially away from said centered position; and a biasing means connected between said plow blade and each of said wings for biasing said wings to said closed position.

22. The plow assembly defined in claim 21 wherein said plow blade is pivotally connected with said support frame for rotation of said plow blade about a generally horizontal axis between a normally generally vertical position and a generally horizontal position, and the plow assembly further includes trip biasing means for biasing said plow blade to said generally vertical position.

23. The plow assembly defined in claim 22 further including a power rotation device for rotating said plow blade between said centered position and said angled positions.

24. The plow assembly defined in claim 23 wherein said power rotation device includes a pair of hydraulic cylinders, one of said cylinders being positioned along a first side of said support frame and connected between said support frame and said plow blade, a second of said cylinders being positioned along a second side of said support frame opposite said one cylinder and connected between said support frame and said plow blade.

25. A winged plow assembly for use with a vehicle to push material from a surface to be cleared, comprising:

a support frame adapted to pivotally connect with the vehicle and to extend away from the vehicle along a longitudinal centerline of the vehicle, said support frame having a longitudinal axis oriented generally parallel with the vehicle centerline;

an elongated plow blade having two opposing ends and pivotally connected with said support frame to rotate generally horizontally between a centered position with said plow blade oriented generally perpendicular to said longitudinal axis and a number of angled positions with said plow blade oriented at an angle relative to said longitudinal axis, said plow blade also being pivotally connected with said support frame to rotate about a generally horizontal axis between a normally generally vertical position and a generally horizontal position when a bottom edge of said plow blade engages a protrusion on a surface to be plowed clear;

a pair of plow blade wings, one of said pair of wings being pivotally connected with one end of said plow blade and the other of said pair of wings being pivotally connected with the opposing end of said plow blade, each said wing rotating between a closed position in which said wings project generally forwardly, said wings and said plow blade defining a generally U-shaped assembly in said closed position so said wings facilitate pushing material with said plow assembly, and an open position in which said wings project in generally opposite directions, away from each other, and are oriented generally parallel to said plow blade to effectively extend the length of said plow blade so said wings facilitate moving material to the side of the plow assembly; and actuator means responsive to the position of said plow blade relative to said support frame for rotating at least one of said wings between said closed position when said plow blade is substantially in said centered position and said open position when said plow blade is rotated substantially away from said centered positions.

26. The plow assembly defined in claim 25 wherein said actuator means includes at least one cable interconnecting at least said one wing with said support frame for pulling said one wing into said open position when said plow blade is rotated substantially away from said centered position.

27. The plow assembly defined in claim 26 wherein said cable has a first portion extending between one of said wings and said support frame and a second portion extending between the other of said wings and said support frame and each of said first and second cable portions is positioned adjacent said horizontal axis.

28. The plow assembly defined in claim 27 further including a biasing means connected between said plow blade and each of said wings for biasing said wings to said closed position.

29. The plow assembly defined in claim 28 further including trip biasing means for biasing said plow blade to said generally vertical position.

30. The plow assembly defined in claim 25 wherein said actuator means includes a mechanical power source connected with said at least one of said wings to manipulate said at least one of said wings between said open and closed positions and a control operatively connected with said mechanical power source, said control having a sensor responsive to the position of said plow blade relative to said support frame, said control sending an open signal to said mechanical power source when said plow blade is rotated substantially away from said centered position so said mechanical power source opens said at least one of said wings and sending a close signal to said mechanical power source when said plow blade is substantially in said centered position so said mechanical power source closes said at least one of said wings.

31. The plow assembly defined in claim 30 further including trip biasing means for biasing said plow blade to said generally vertical position.

32. The plow assembly defined in claim 31 further including a power rotation device having a pair of hydraulic cylinders for rotating said plow blade between said centered position and said angled positions, one of said cylinders connecting between each of two opposing sides of said support frame and said plow blade.

33. The plow assembly defined in claim 25 wherein said actuator means includes a series of linkages operatively interconnecting at least one of said two pair of wings with said support frame.

34. The plow assembly defined in claim 33 wherein said actuator means further includes a rod member operatively connected between said one of said pair of wings and said series of linkages.

35. The plow assembly defined in claim 34 wherein said rod member extends coaxially along said horizontal axis.

36. The plow assembly defined in claim 25 wherein said actuator means includes a first series of mechanical linkages operatively interconnecting one of said pair of wings with said support frame and includes a second series of mechanical linkages operatively interconnecting a second of said pair of wings with said support frame.

37. The plow assembly defined in claim 36 wherein said actuator means further includes a first rod member operatively connected between said one of said pair of wings and said first series of mechanical linkages and a second rod member operatively connected between said second of said pair of wings and said second series of mechanical linkages and wherein each of said first and second rod members extend coaxially along said horizontal axis.

38. A winged plow assembly for use with a vehicle to push material from a surface to be cleared, comprising:

a support frame adapted to pivotally connect with the vehicle and to extend away from the vehicle along a longitudinal centerline of the vehicle, said support frame having a longitudinal axis oriented generally parallel with the vehicle centerline;

an elongated plow blade having two opposing ends and pivotally connected with said support frame to rotate generally horizontally between a centered position with said plow blade oriented generally perpendicular to said longitudinal axis and a number of angled positions with said plow blade oriented at an angle relative to said longitudinal axis, said plow blade also being pivotally connected with said support frame to rotate about a generally horizontal axis between a normally generally vertical position and a generally horizontal position when a bottom edge of said plow blade engages a protrusion on a surface to be plowed clear.

a pair of plow blade wings, one of said pair of wings being pivotally connected with one end of said plow blade and the other of said pair of wings being pivotally connected with the opposing end of said plow blade, each said wing rotating between a closed position in which said wings project generally forwardly, said wings and said plow blade defining a generally U-shaped assembly in said closed position so said wings facilitate pushing material with said plow assembly, and an open position in which said wings project in generally opposite directions, away from each other to effectively extend the length of said plow blade so said wings facilitate moving material to the side of the plow assembly; and actuator means responsive to the position of said plow blade relative to said support frame for rotating at least one of said wings between said closed position when said plow blade is substantially in said centered position and said open position when said plow blade is rotated substantially away from said centered position, said actuator means including at least one cable interconnecting said at least one of said wings with said support frame to pull said at least one of said wings into said open position when said plow blade is rotated substantially away from said centered position, said cable having a first portion extending between said at least one of said wings and said support frame and a second portion extending between the other of said wings and said support frame, each of said first and second cable portions being positioned adjacent said horizontal axis, said actuator means further including a latch for latching said wings in said closed position when said plow blade is substantially in said centered position and for releasing said wings from said closed position when said plow blade is rotated substantially away from said centered position to one of said angled positions.

39. The plow assembly defined in claim 38 wherein said latch includes:

a first latch plate on said plow blade near said one wing;

a first latch arm extending from said one wing, said first latch arm being adapted for latching engagement with and release from said first latch plate;

a second latch plate on said plow blade near said other wing; and a second latch arm extending from said other wing, said second latch arm being adapted for latching engagement with and release from said second latch plate.

40. The plow assembly defined in claim 38 further including a power rotation device having a pair of hydraulic cylinders for rotating said plow blade between said centered position and said angled positions, one of said cylinders connecting between each of two opposing sides of said support frame and said plow blade.

41. A winged plow assembly for use with a vehicle, comprising:

a support frame adapted to pivotally connect with the vehicle and to extend away from the vehicle along a longitudinal centerline of the vehicle, said support frame having a longitudinal axis oriented generally parallel with the vehicle centerline;

an elongated plow blade having two opposing ends and pivotally connected with said support frame to rotate generally horizontally between a centered position with said plow blade oriented generally perpendicular to said longitudinal axis and a number of angled positions with said plow blade oriented at an angle relative to said longitudinal axis;

a pair of plow blade wings, one of said pair of wings being pivotally connected with one end of said plow blade and the other of said pair of wings being pivotally connected with the opposing end of said plow blade, each said wing rotating between a closed position in which said wings project generally forwardly, said wings and said plow blade defining a generally U-shaped assembly in said closed position so said wings facilitate pushing material with said plow assembly, and an open position in which said wings project in generally opposite directions, away from each other to effectively extend the length of said plow blade so said wings facilitate moving material to the side of the plow assembly; and actuator means responsive to the position of said plow blade relative to said support frame for manipulating at least one of said wings between said closed position when said plow blade is substantially in said centered position and said open position when said plow blade is rotated substantially away from said centered position, said actuator means including holding means for locking said wings in said closed position when said plow blade is substantially in said centered position.

42. The plow assembly defined in claim 41 wherein said actuator means interconnects said wings with said support frame so that said wings rotate between said closed position when said plow blade is in said centered position and said open position when said plow blade is in one of said angled positions.

43. The plow assembly defined in claim 42 wherein said actuator means includes cable means for interconnecting said wings with said support frame for pulling said wings into said open position when said plow blade is rotated substantially away from said centered position.

44. The plow assembly defined in claim 43 wherein said plow blade is pivotally connected with said support frame for rotation of said plow blade about a generally horizontal axis between a normally generally vertical position and a generally horizontal position, and the plow assembly further includes trip biasing means for biasing said plow blade to said generally vertical position.

45. The plow assembly defined in claim 44 wherein said cable means includes a first cable portion extending between one of said wings and said support frame and a second cable portion extending between the other of said wings and said support frame and each of said first and second cable portions is positioned adjacent said horizontal axis.

46. The plow assembly defined in claim 45 further including a biasing means connected between said plow blade and each of said wings for biasing said wings to said closed position.

47. The plow assembly defined in claim 46 further including a power rotation device having a pair of hydraulic cylinders for rotating said plow blade between said centered position and said angled positions, one of said cylinders being positioned along a first side of said support frame and connected between said support frame and said plow blade, a second of said cylinders being positioned along a second side of said support frame opposite said one cylinder and connected between said support frame and said plow blade.

48. The plow assembly defined in claim 41 wherein said actuator means includes a mechanical power source connected with said at least one of said wings to manipulate said at least one of said wings between said open and closed positions and a control operatively connected with said mechanical power source, said control having a sensor responsive to the position of said plow blade relative to said support frame, said control sending an open signal to said mechanical power source when said plow blade is rotated substantially away from said centered position so said mechanical power source opens said at least one of said wings and sending a close signal to said mechanical power source when said plow blade is substantially in said centered position so said mechanical power source closes said at least one of said wings.

49. The plow assembly defined in claim 48 wherein said plow blade is pivotally connected with said support frame for rotation of said plow blade about a generally horizontal axis between a normally generally vertical position and a generally horizontal position when a bottom edge of said plow blade engages a protrusion from a surface to be cleared of material, the protrusion resisting said plow blade pushing the protrusion, and the plow assembly further includes trip biasing means for biasing said plow blade to said generally vertical position.

50. The plow assembly defined in claim 49 further including a power rotation device having a pair of hydraulic cylinders for rotating said plow blade between said centered position and said angled positions, one of said cylinders connecting between each of two opposing sides of said support frame and said plow blade.

51. The plow assembly defined in claim 41 wherein said actuator means includes a series of linkages operatively interconnecting at least one of said two pair of wings with said support frame.

52. The plow assembly defined in claim 51 wherein said actuator means further includes a rod member operatively connected between said one of said pair of wings and said series of linkages.

53. The plow assembly defined in claim 52 wherein said plow blade is pivotally connected with said support frame for rotation of said plow blade about a generally horizontal axis between a normally generally vertical position and a generally horizontal position, and the plow assembly further includes trip biasing means for biasing said plow blade to said generally vertical position.

54. The plow assembly defined in claim 53 wherein said rod member extends coaxially along said horizontal axis.

55. The plow assembly defined in claim 41 wherein said actuator means includes a first series of mechanical linkages operatively interconnecting one of said pair of wings with said support frame and includes a second series of mechanical linkages operatively interconnecting a second of said pair of wings with said support frame.

56. The plow assembly defined in claim 55 wherein said plow blade is pivotally connected with said support frame for rotation of said plow blade about a generally horizontal axis between a normally generally vertical position and a generally horizontal position, and the plow assembly further includes trip biasing means for biasing said plow blade to said generally vertical position.

57. The plow assembly defined in claim 56 wherein said actuator means further includes a first rod member operatively connected between said one of said pair of wings and said first series of mechanical linkages and a second rod member operatively connected between said second of said pair of wings and said second series of mechanical linkages and wherein each of said first and second rod members extend coaxially along said horizontal axis.

58. A winged plow assembly for use with a vehicle, comprising:

a support frame adapted to pivotally connect with the vehicle and to extend away from the vehicle along a longitudinal centerline of the vehicle, said support frame having a longitudinal axis oriented generally parallel with the vehicle centerline;

an elongated plow blade having two opposing ends and pivotally connected with said support frame to rotate generally horizontally between a centered position with said plow blade oriented generally perpendicular to said longitudinal axis and a number of angled positions with said plow blade oriented at an angle relative to said longitudinal axis;

a pair of plow blade wings, one of said pair of wings being pivotally connected with one end of said plow blade and the other of said pair of wings being pivotally connected with the opposing end of said plow blade, each said wing rotating between a closed position in which said wings project generally forwardly, said wings and said plow blade defining a generally U-shaped assembly in said closed position so said wings facilitate pushing material with said plow assembly, and an open position in which said wings project in generally opposite directions, away from each other to effectively extend the length of said plow blade so said wings facilitate moving material to the side of the plow assembly; and actuator means responsive to the position of said plow blade relative to said support frame for manipulating at least one of said wings between said closed position when said plow blade is substantially in said centered position and said open position when said plow blade is rotated substantially away from said centered position, said actuator means including holding means for holding said wings in said closed position when said plow blade is substantially in said centered position, said actuator means including cable means for interconnecting said wings with said support frame to pull said wings into said open position when said plow blade is rotated substantially away from said centered position, said holding means including a first latch plate on said plow blade near said one wing, including a first latch arm extending from said one wing, said first latch arm being adapted for latching engagement with and release from said first latch plate, including a second latch plate on said plow blade near said other wing, and including a second latch arm extending from said other wing, said second latch arm being adapted for latching engagement with and release from said second latch plate.

* * * * *

UNITED STATES PATENT AND TRADEMARK OFFICE

CERTIFICATE OF CORRECTION

PATENT NO. : 5,285,588

DATED : February 15, 1994

INVENTOR(S) : Niemela et al

It is certified that error appears in the above-indentified patent and that said Letters Patent is hereby corrected as shown below:

Column 2, line 30;

"ma" should be –may–.

Column 3, line 65;

"Fig. 2" should be –Fig. 23–.

Column 9, line 42;

"50" should be –150–.

Column 9, line 50;

"88" should be "188".

Column 12, line 60;

"en" should be –end–.

Column 13, line 13;

After "key 324" insert – . –.

UNITED STATES PATENT AND TRADEMARK OFFICE

CERTIFICATE OF CORRECTION

PATENT NO. : 5,285,588

DATED : February 15, 1994

INVENTOR(S) : Niemela et al

It is certified that error appears in the above-indentified patent and that said Letters Patent is hereby corrected as shown below:

Column 16, claim 9, line 6;

"direction," should be –directions,–.

Signed and Sealed this

Eighteenth Day of October, 1994

*Attest:*

Bruce Lehman

BRUCE LEHMAN

*Attesting Officer*

*Commissioner of Patents and Trademarks*